US009945177B2

(12) United States Patent
Drew et al.

(10) Patent No.: US 9,945,177 B2
(45) **Date of Patent: *Apr. 17, 2018**

(54) COVERING FOR AN ARCHITECTURAL OPENING HAVING NESTED ROLLERS

(71) Applicant: Hunter Douglas Inc., Pearl River, NY (US)

(72) Inventors: Terrence M. Drew, Superior, CO (US); Kenneth M. Faller, Thornton, CO (US); Kent A. Smith, Broomfield, CO (US)

(73) Assignee: Hunter Douglas Inc., Pearl River, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/213,449

(22) Filed: Mar. 14, 2014

(65) Prior Publication Data

US 2014/0262069 A1 Sep. 18, 2014

Related U.S. Application Data

(60) Provisional application No. 61/801,811, filed on Mar. 15, 2013.

(51) Int. Cl.
*E06B 9/44* (2006.01)
*E06B 9/42* (2006.01)
(Continued)

(52) U.S. Cl.
CPC ..... *E06B 9/44* (2013.01); *E06B 9/42* (2013.01); *E06B 2009/2435* (2013.01); *E06B 2009/405* (2013.01)

(58) Field of Classification Search
CPC .... E06B 9/44; E06B 9/264; E06B 2009/2423; E06B 2009/2435; E06B 2009/2452;
(Continued)

(56) References Cited

U.S. PATENT DOCUMENTS 824,930 A 7/1906 Hopkins
1,153,015 A * 9/1915 Bauer ..... E06B 9/78 160/273.1
(Continued)

FOREIGN PATENT DOCUMENTS

CA 2178167 A1 12/1996
CA 2777454 A1 11/2012
(Continued)

OTHER PUBLICATIONS

U.S. Appl. No. 14/212,387, filed Mar. 14, 2014.
(Continued)

*Primary Examiner* — Blair M Johnson

(57) ABSTRACT

A covering for an architectural opening is provided. The covering may include an outer roller, an inner roller received within the outer roller, a first shade secured to and adapted to be wrapped around the outer roller, and a second shade secured to and adapted to be wrapped around the inner roller. The outer roller may define an elongated slot through which the second shade extends and retracts. Opposite ends of the inner roller may be aligned with corresponding ends of the outer roller. A mounting system may support the inner and outer rollers for rotative movement about a central longitudinal axis of the inner roller. A bottom rail of the second shade may engage the outer roller when the second shade is in the fully retracted position. Rotation of the inner roller when the second shade is in a retracted position may cause rotation of the outer roller.

14 Claims, 19 Drawing Sheets

(51) Int. Cl.
*E06B 9/24* (2006.01)
*E06B 9/40* (2006.01)

(58) Field of Classification Search
CPC .... E06B 2009/2458; E06B 9/405; E06B 9/34; E06B 9/42; E06B 9/72; E06B 2009/802; E06B 2009/801; E06B 2009/804
USPC ..... 160/67
See application file for complete search history.

(56) References Cited

U.S. PATENT DOCUMENTS 1,171,215 A * 2/1916 Lane ..... E06B 9/78 160/300
2,280,358 A 4/1942 Tietig
2,503,101 A 4/1950 Drury
3,007,342 A 11/1961 Wardlaw
3,063,495 A 11/1962 Petrick
3,285,325 A 11/1966 Easton
4,020,889 A 5/1977 Karoll
4,214,621 A * 7/1980 Wessels ..... E04F 10/0633 160/66
4,237,956 A 12/1980 Sivin et al.
4,372,432 A 2/1983 Waine et al.
4,433,765 A 2/1984 Rude et al.
4,610,293 A 9/1986 Weiblen
4,813,468 A 3/1989 Fraser
5,205,334 A 4/1993 Judkins
5,228,936 A 7/1993 Goodhue
5,313,999 A 5/1994 Colson et al.
D348,371 S 7/1994 Judkins
5,419,385 A 5/1995 Vogel et al.
5,647,421 A * 7/1997 Hoffmann et al. ..... 160/120
5,791,390 A 8/1998 Watanabe
5,897,731 A 4/1999 Colson et al.
6,164,362 A 12/2000 Yang
D446,070 S 8/2001 Judkins
6,289,964 B1 9/2001 Colson et al.
6,435,252 B2 8/2002 Colson et al.
6,516,856 B2 2/2003 Lai
6,530,413 B2 3/2003 Hwang
6,651,720 B1 11/2003 DiSilvestro et al.
6,712,115 B2 3/2004 Judkins
6,834,701 B2 12/2004 Colson et al.
6,876,493 B1 4/2005 Lin
7,059,377 B2 6/2006 Nien et al.
7,063,122 B2 6/2006 Colson et al.
7,093,643 B2 8/2006 Ikle
7,128,126 B2 * 10/2006 Smith et al. ..... 160/319
7,143,802 B2 12/2006 Strand et al.
7,159,635 B2 1/2007 Holt et al.
7,500,505 B2 3/2009 Smith et al.
7,549,455 B2 6/2009 Harper et al.
7,571,756 B2 8/2009 Smith et al.
7,617,858 B2 11/2009 Hoffmann et al.
7,617,859 B2 11/2009 Auger
7,686,060 B2 3/2010 Anthony
7,740,044 B2 * 6/2010 Gutierrez ..... 160/56
7,849,907 B2 12/2010 Jang
7,857,033 B2 12/2010 Malausa
D659,455 S 5/2012 Marocco
D659,456 S 5/2012 Marocco
8,171,640 B2 5/2012 Colson et al.
8,186,412 B2 5/2012 Lin
D711,156 S 8/2014 Judkins
8,820,386 B2 9/2014 Mullet et al.
9,259,833 B2 2/2016 Bonini et al.
D764,835 S 8/2016 Buccola, Jr. et al.
9,567,802 B2 * 2/2017 Buccola, Jr. ..... E06B 9/322
2001/0001414 A1 5/2001 Colson et al.
2002/0189771 A1 12/2002 Colson et al.
2003/0000652 A1 1/2003 Hwang
2004/0074611 A1 4/2004 Colson et al.
2004/0079492 A1 4/2004 Lin
2005/0051281 A1 3/2005 Lai
2005/0087309 A1 4/2005 Nien et al.
2005/0139329 A1 6/2005 Hoffman
2006/0027339 A1 2/2006 Hsu
2006/0137833 A1 6/2006 Nichols, Jr. et al.
2007/0144686 A1 6/2007 Drew
2008/0053626 A1 3/2008 Jarosinski et al.
2008/0093030 A1 * 4/2008 Gutierrez ..... 160/67
2008/0149280 A1 6/2008 Smith et al.
2008/0223532 A1 9/2008 Auger
2011/0061821 A1 * 3/2011 Kim ..... E06B 9/264 160/305
2011/0067820 A1 3/2011 Hsu
2012/0118514 A1 5/2012 Hughes
2012/0222824 A1 9/2012 Lin
2012/0291964 A1 11/2012 Marocco
2012/0291965 A1 11/2012 Marocco
2013/0098564 A1 4/2013 Jang
2013/0306250 A1 11/2013 Mullet et al.
2014/0053989 A1 2/2014 Colson et al.
2014/0166218 A1 6/2014 Ng
2014/0216666 A1 8/2014 Smith et al.
2014/0262066 A1 9/2014 Certain et al.
2014/0262068 A1 9/2014 Buccola, Jr. et al.
2014/0367053 A1 12/2014 Cha
2014/0367054 A1 12/2014 Cha
2015/0047792 A1 2/2015 Lukosiunas et al.
2015/0226001 A1 8/2015 Adams et al.
2015/0292261 A1 10/2015 Chou
2015/0376941 A1 12/2015 Fujita et al.

FOREIGN PATENT DOCUMENTS

CA 2779772 A1 3/2013
CA 2656981 C 10/2013
CA 2915204 A1 12/2014
DE 1093527 B 11/1960
EP 1455048 A2 9/2004
EP 1895070 A2 3/2008
FR 1557062 A 2/1969
GB 2182738 A 5/1987
WO 2007038447 A2 4/2007

OTHER PUBLICATIONS

PCT International Search Report and PCT Written Opinion of the International Searching Authority for corresponding PCT International Application No. PCT/US2014/042131 dated Dec. 19, 2014, 10 pages.

* cited by examiner

COVERING FOR AN ARCHITECTURAL OPENING HAVING NESTED ROLLERS

CROSS-REFERENCE TO RELATED APPLICATIONS

This application claims the benefit under 35 U.S.C. § 119(e) of U.S. Provisional Application No. 61/801,811, filed Mar. 15, 2013, and entitled "Covering for an Architectural Opening having Nested Rollers", which is hereby incorporated by reference herein in its entirety.

FIELD

The present disclosure relates generally to coverings for architectural openings, and more particularly to apparatus and methods for operating a covering for an architectural opening.

BACKGROUND

Coverings for architectural openings, such as windows, doors, archways, and the like, have taken numerous forms for many years. Some coverings include a retractable shade that is movable between an extended position and a retracted position. In the extended position, the shade of the covering may be positioned across the opening. In the retracted position, the shade of the covering may be positioned adjacent one or more sides of the opening.

Some coverings, when in the fully extended position, transmit light through the material from which the covering is constructed. In some instances, even when the covering has operable vanes that open and close to control the amount of light passing through the covering, a greater amount of darkening is desired. Additionally, or alternatively, in some instances a user may desire a different pattern or appearance of the covering when in the fully extended position. Typically, these goals are accomplished by having a separate roller positioned behind the primary roller for separate actuation by the user. These separate rollers for the supplemental function or appearance increase the size of the head rail, and may require the use of a second set of control cords and operating mechanisms, thus increasing size and weight of the covering structure.

SUMMARY

Examples of the disclosure may include a covering for an architectural opening. The covering may include an outer roller having a central longitudinal axis, an elongated slot formed through a sidewall and extending between ends of the outer roller, an inner roller having a central longitudinal axis and received within the outer roller, the inner roller having ends that are aligned with the ends of the outer roller, a first shade secured to and adapted to be wrapped around the outer roller, a second shade defining a bottom rail and secured to and adapted to be wrapped around the inner roller, a mounting system supporting the inner and outer rollers for rotative movement about the central longitudinal axis of the inner roller, the second shade extending through the elongated slot and being retractable onto and extendable from the inner roller there through, the bottom rail engaging the outer roller when the second shade is in the fully retracted position, an operating mechanism for selectively rotating the inner roller, and the rotation of the inner roller when in the retracted position causing the rotation of the outer roller.

In some examples, the second shade has side edges that are aligned with the ends of the inner and outer rollers. In some examples, the outer roller defines a longitudinal seat formed along the slot, and the second bottom rail is received in the seat when the inner roller is in the retracted position. In some examples, the slot is oriented orthogonally to a direction of extension of the first shade. In some examples, the seat defines a recess with an opening in a direction of extension of the first shade.

In some examples, the covering further includes a lock mechanism movable between a first position restricting the rotation of the outer roller and a second position permitting rotation of the outer roller. In some examples, the lock mechanism moves from the first position to the second position upon engagement of the bottom rail with the lock mechanism. In some examples, the outer roller defines an elongated groove formed in the sidewall, the lock mechanism includes a bearing, and in the first position of the lock mechanism, the bearing is received in the groove. In some examples, the lock mechanism includes a pin, and the lock mechanism is actuated upon engagement of the pin by the bottom rail to remove the bearing from the groove. In some examples, the bearing movably engages the outer surface of the outer roller in the second position.

In another example, a method of operating a dual panel covering for an architectural opening is provided. The method may include providing an inner roller positioned inside an outer roller, locking rotation of the outer roller, rotating the inner roller relative to the outer roller to retract, until fully retracted, an extended second shade onto the inner roller through a slot formed in the outer roller, actuating the rotation lock at the fully retracted position of the inner roller to allow the outer roller to rotate, and rotating the outer roller by driving the inner roller to retract a first shade onto the outer roller.

This summary of the disclosure is given to aid understanding, and one of skill in the art will understand that each of the various aspects and features of the disclosure may advantageously be used separately in some instances, or in combination with other aspects and features of the disclosure in other instances. Accordingly, while the disclosure is presented in terms of examples, it should be appreciated that individual aspects of any example can be claimed separately or in combination with aspects and features of that example or any other example.

The present disclosure is set forth in various levels of detail in this application and no limitation as to the scope of the claimed subject matter is intended by either the inclusion or non-inclusion of elements, components, or the like in this summary. In certain instances, details that are not necessary for an understanding of the disclosure or that render other details difficult to perceive may have been omitted. It should be understood that the claimed subject matter is not necessarily limited to the particular examples or arrangements illustrated herein.

BRIEF DESCRIPTION OF THE DRAWINGS

The accompanying drawings, which are incorporated into and constitute a part of the specification, illustrate examples of the disclosure and, together with the general description given above and the detailed description given below, serve to explain the principles of these examples.

DETAILED DESCRIPTION

The present disclosure provides a dual panel covering for an architectural opening. In general, the covering may include a first shade and a second shade both suspended from the same head rail by a pair of nested rollers forming a dual roller unit. The first shade (front shade in this configuration) is engaged with an outer roller for retraction onto and extension therefrom by wrapping around and unwrapping from the outer roller as actuated by a user. The second shade (rear shade in this configuration) is engaged with an inner roller, which is positioned inside the outer roller, for retraction onto and extension therefrom by wrapping around and unwrapping from the outer roller as actuated by the user. The inner roller positioned inside the outer roller forms a roller unit, and is further described below. The second shade may be extended and retracted as directed by the user when the first shade is in the fully extended position. The operating unit that causes the rollers to rotate as directed by the user may be operated by one control cord, which may engage and control the rotation of the inner roller, which in turn controls the rotation of the outer tube.

Figure 1:
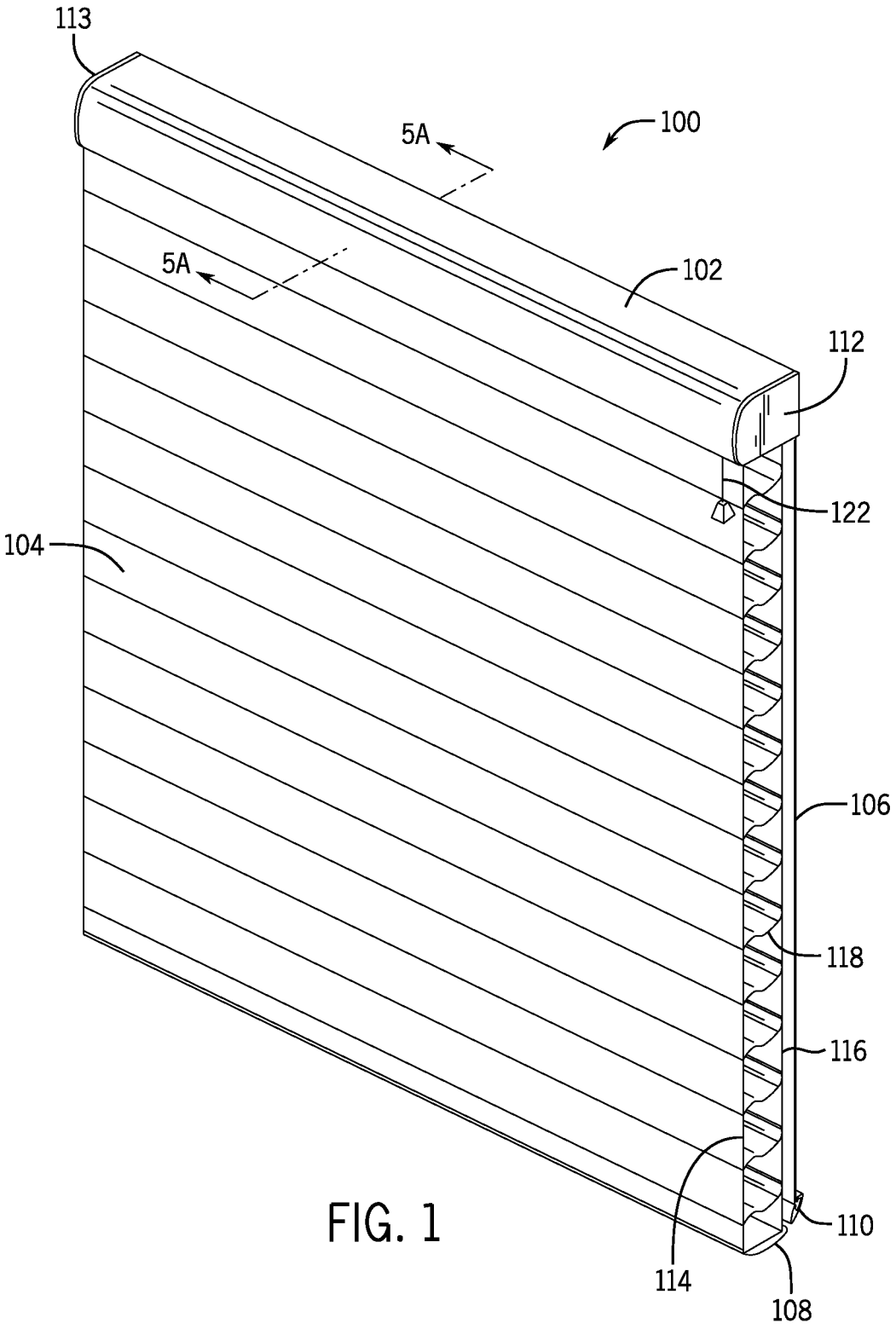
FIG. 1 is an isometric view of a covering with first and second shades in fully-extended positions in accordance with some examples of the present disclosure.
Figure 2:
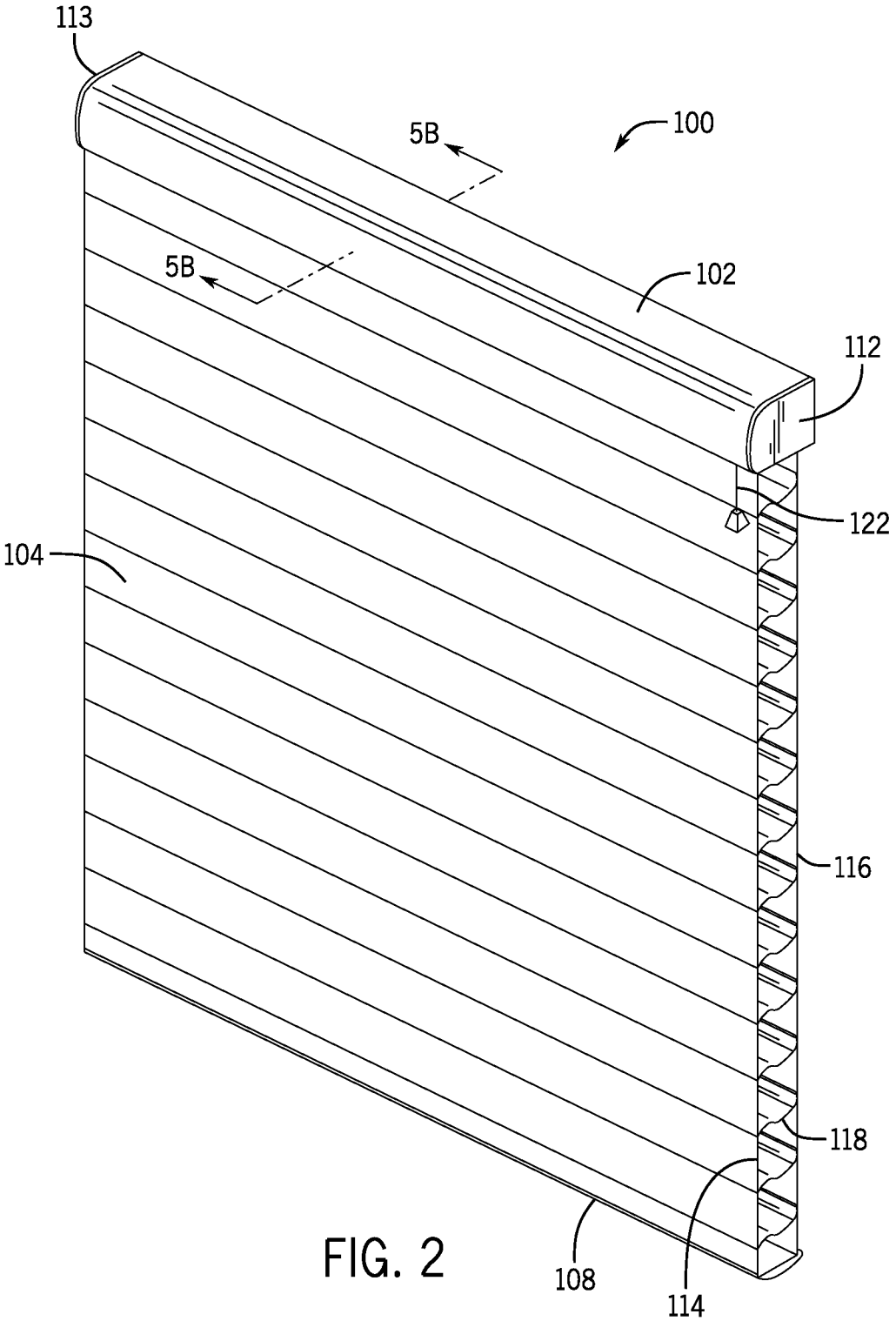
FIG. 2 is an isometric view of the covering of FIG. 1 with the first shade in a fully-extended, open position and the second shade in a fully-retracted position in accordance with some examples of the present disclosure.

Referring to FIGS. 1 and 2, a retractable covering 100 for an architectural opening is provided. The retractable covering 100 includes a head rail 102, a first shade 104 and a second shade 106, a first bottom rail 108, and a second bottom rail 110. The first shade 104 extends between the head rail 102 and the first bottom rail 108. The second shade 106 extends between the head rail 102 and the second bottom rail 110. The head rail 102 includes two opposing end caps 112, 113, which may enclose the ends of the head rail 102 to provide a finished appearance. The first bottom rail 108 may extend horizontally along a lower edge of the first shade 104 and may function as a ballast to maintain the first shade 104 in a taut condition. The second bottom rail 110 may extend horizontally along a lower edge of the second shade 106 and may function as a ballast to maintain the second shade 106 in a taut condition.

The first shade 104 may include vertically suspended front 114 and rear 116 sheets of flexible material (such as sheer fabric) and a plurality of horizontally-extending, vertically-spaced flexible vanes 118. Each of the vanes 118 may be secured along horizontal lines of attachment with a front edge directed downwardly and attached to the front sheet 114 and a rear edge directed upwardly attached to the rear sheet 116. The sheets 114, 116 and vanes 118 may form a plurality of elongated, vertically-aligned, longitudinally-extending, transversely-collapsible cellular units which are longitudinally secured, such as adhered, to adjacent cellular units to define a vertical stack of cellular units, which may be referred to as a cellular panel. The sheets 114, 116 and/or the vanes 118 may be constructed of continuous lengths of material or may be constructed of strips of material attached or joined together in an edge-to-edge, overlapping, or other suitable relationship.

The first shade 104 may be constructed of substantially any type of material. For example, the first shade 104 may be constructed from natural and/or synthetic materials, including fabrics, polymers, and/or other suitable materials. Fabric materials may include woven, non-woven, knits, or other suitable fabric types. The first shade 104 may have any suitable level of light transmissivity. For example, the first shade 104, including the sheets 114, 116 and/or the vanes 118, may be constructed of transparent, translucent, and/or opaque materials to provide a desired ambience or décor in an associated room. In one example, the sheets 114, 116 are transparent and/or translucent, and the vanes 118 are translucent and/or opaque.

The second shade 106 may be constructed of substantially any type of material, and in the example described herein is made of a single sheet of material with zero light transmissivity, often referred to as a black-out shade. It is contemplated that the second shade 106 may be constructed from natural and/or synthetic materials, including fabrics, polymers, and/or other suitable materials. Fabric materials may include woven, non-woven, knits, or other suitable fabric types. The second shade 106 may have any suitable level of light transmissivity. For example, the second shade 106 may be constructed of transparent, translucent, and/or opaque materials to provide a desired ambience or décor in an associated room. The second shade 106 may also have patterns or designs created on it so that when it is extended behind the first shade 104 it creates a different aesthetic appearance than the first shade 104 by itself.

The covering 100 may include a drive mechanism configured to raise or retract the first and second shades 104, 106. The drive mechanism may include an operating mechanism 120 and an operating element 122 (such as a cord or ball chain) operably coupled to the operating mechanism 120 to allow the user to extend or retract the first and/or second shades 104, 106. If the covering 100 is motorized, the operating mechanism 120 may be operably coupled to a motor, and the covering 100 may include a receiver operable to communicate with a transmitter, such as a remote control unit. As such, the covering 100 may be operated mechanically and/or electrically.

To move the first and/or second shade 104, 106, an operator may manipulate the operating element 122 (see FIGS. 1 and 2). For example, to raise or retract the first and/or second shades 104, 106 from an extended position, the operator may pull the operating element 122 downward in short, reciprocating strokes. To extend or lower the first and/or second shades 104, 106 from a retracted position, the operator may manipulate the operating element 122 to release a brake, which may allow the first and/or second shades 104, 106 to automatically lower under the influence of gravity. Alternatively, the operating element 122 may be replaced with an electric motor configured to extend or retract the first and/or second shades 104, 106 upon receiving an extension or retraction command. The motor may include a gravity lower state to permit the first and/or second shades 104, 106 to lower via gravity without motor intervention, thereby reducing power consumption. The covering 100 may include a speed governing device to control or regulate the extension or lowering speed of the first and/or second shades 104, 106. Additionally, the operating element 122 may be a continuous loop, which actuates a corresponding operating mechanism 120 to rotate an inner roller 124 (see FIGS. 4A and 4B) to cause it to rotate in a retraction or extension direction as desired.

Referring to FIG. 1, the covering 100 is shown with the first shade 104 and the second shade 106 both in the fully extended position with the vanes 118 in an open configuration. The second shade 106, in this example, is a blackout shade and inhibits light from passing through the second shade 106, and thus through the first shade 104. FIG. 2 depicts the first shade 104 in a fully extended position with the vanes 118 in an open or expanded configuration. In this position, the front and rear sheets 114, 116 are horizontally spaced with the vanes 118 extending substantially horizontally therebetween. The second shade 106 is withdrawn into the head rail 102, and is wrapped about the inner roller 124 of the covering 100, as described below.

Figure 3:
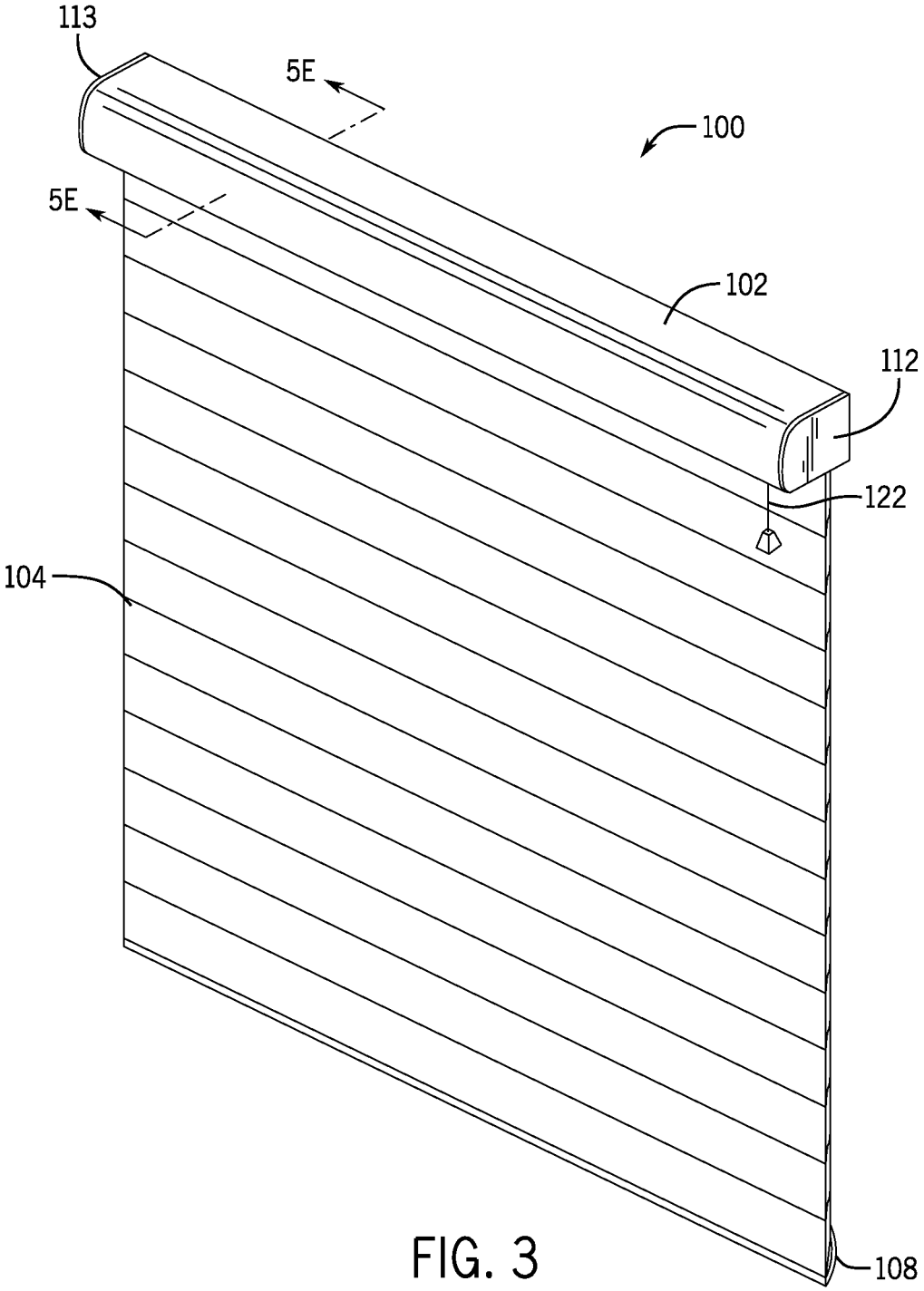
FIG. 3 is an isometric view of the covering of FIG. 1 with the first shade in a partially-extended position and the second shade in a fully-retracted position in accordance with some examples of the present disclosure.

FIG. 3 depicts the first shade 104 in a position of full extension, but with the vanes 118 in the closed or collapsed position. Rotation of an outer roller 126 (see FIGS. 4A and 4B) in the retraction direction, starting in the position shown in FIG. 2, moves the front and rear sheets 114, 116 generally vertically (relative to each other) to shift the vanes 118 from open (FIG. 2) to closed (FIG. 3). When in the closed or collapsed position of FIG. 3, the front and rear sheets 114, 116 are relatively close together and the vanes 118 extend vertically in an approximately coplanar, contiguous relationship with the front and rear sheets 114, 116.

Figure 4A:
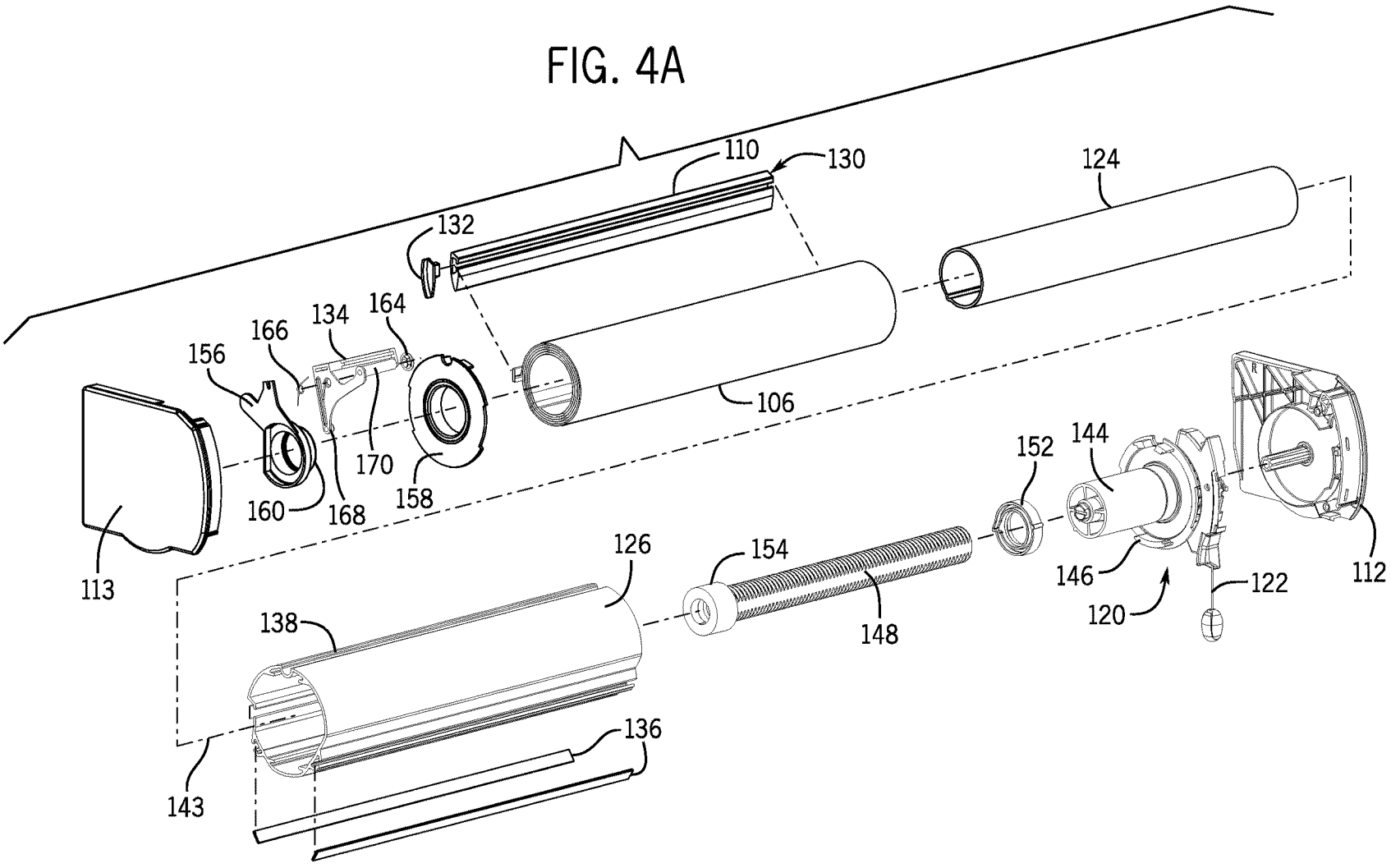
FIG. 4A is an isometric, partially-exploded view of some components of the covering of FIG. 1 in accordance with some examples of the present disclosure. The head rail cover and the second shade are not shown for clarity.
Figure 4B:
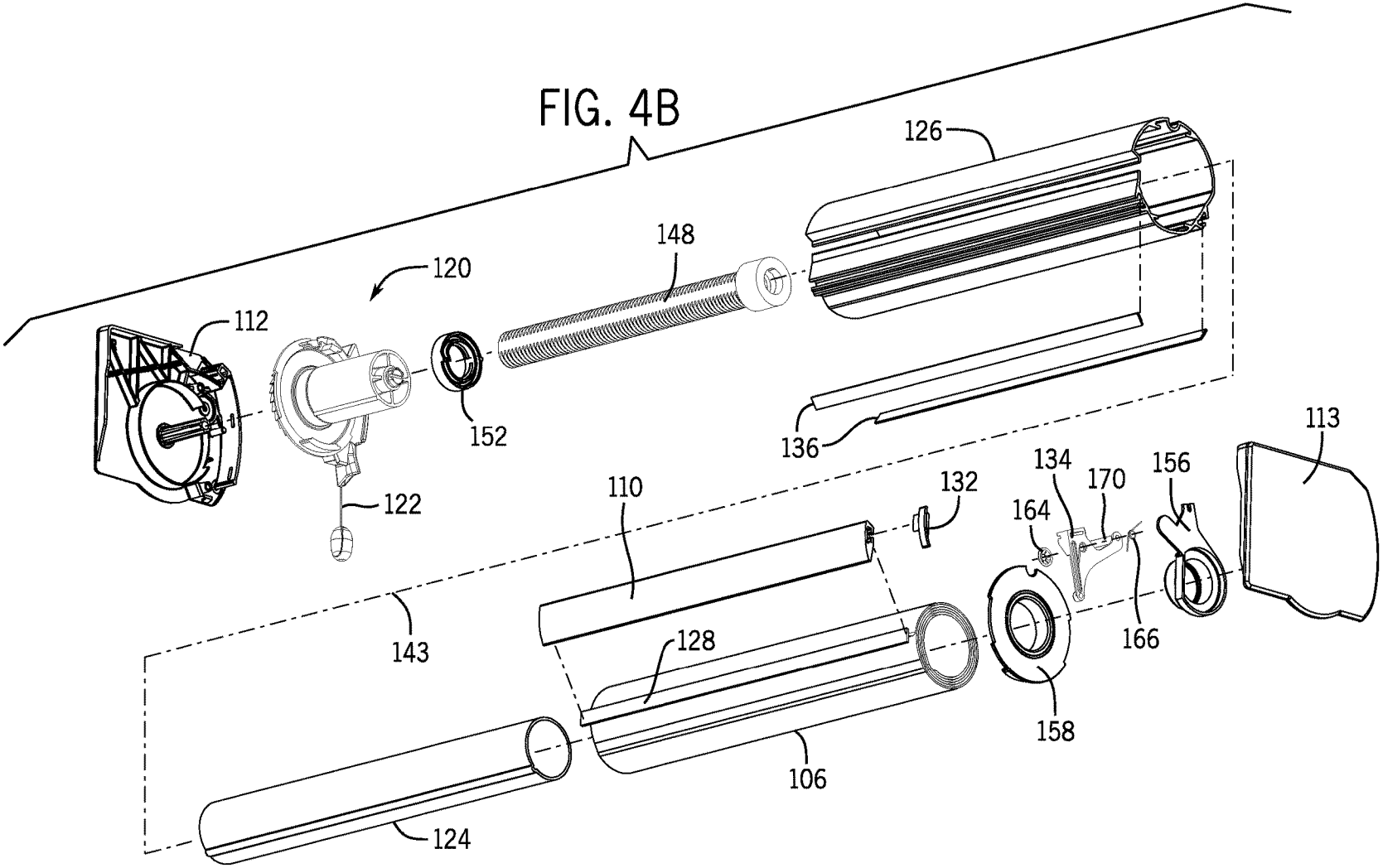
FIG. 4B is another isometric, partially-exploded view of the components of FIG. 4A in accordance with some examples of the present disclosure.

Referring to FIGS. 4A and 4B, each is an exploded view of one example of the head rail 102, inner roller 124, outer roller 126, and operating mechanism 120 from different perspectives. The cover of the head rail 102 and the first shade 104 is not shown for clarity.

The inner roller 124 is generally cylindrical in shape, and forms a retaining member for securing the top edge of the second shade 106 thereto. As noted above, the inner roller 124 is positioned inside the outer roller 126 to define a dual roller unit, and in this example both rollers 124, 126 are coextensive about the same rotational axis. The second shade 106 is attached at a top edge to the inner roller 124 by many acceptable means. The lower edge of the second shade 106 is received in a slot 130 formed in the second bottom rail 110, and held in the slot 130 by an insert 128 positioned in a hem formed on the bottom edge. Many other attachment structures would be suitable.

The second bottom rail 110 is an elongated member, having relatively high mass, and defining a slot 130 running along its length to receive and retain, as noted above, the bottom edge of the second shade 106. The second bottom rail 110 has a generally triangular cross section, a portion of which generally matches the shape of a seat 142 formed on the outer roller 126 to conform thereto when the second shade 106 is in the retracted position. An actuator rim 132 is defined at one end of the second bottom rail 110, and engages a roller lock 134 to disengage the roller lock 134 from the outer roller 126, as is described in more detail below.

The outer roller 126 in this example is generally cylindrical, and defines several features in its circumferential wall. The outer roller 126 defines a longitudinal central axis 143 about which it rotates, and about which the inner roller 124 is coextensively positioned also. A pair of channels 172 in the outer roller 126 is formed to receive and secure the top edges of the first shade 104, with inserts 136 each being positioned in a hem formed on each of the top edges, the insert 136 acting to retain the top edge in the respective channel 172. An anchor groove 138 is formed along the length of the outer roller 126 for receipt of a roller lock bearing 170, as is described below. A slot 140 is formed along the length of the outer roller 126 and is in communication with the interior of the outer roller 126. A recessed seat 142 is formed on either side of the slot 140. The second shade 106 is extended and retracted through the slot 140, and when in the fully retracted position, the second bottom rail 110 is received in the seat 142 and nests therein for at least one of many purposes, as is described below. The slot 140 is positioned on the outer roller 126 so as to be located above and adjacent to the rearward most of the two channels 172 when the first shade 104 is in its extended position and vane-open configuration.

Figure 10:
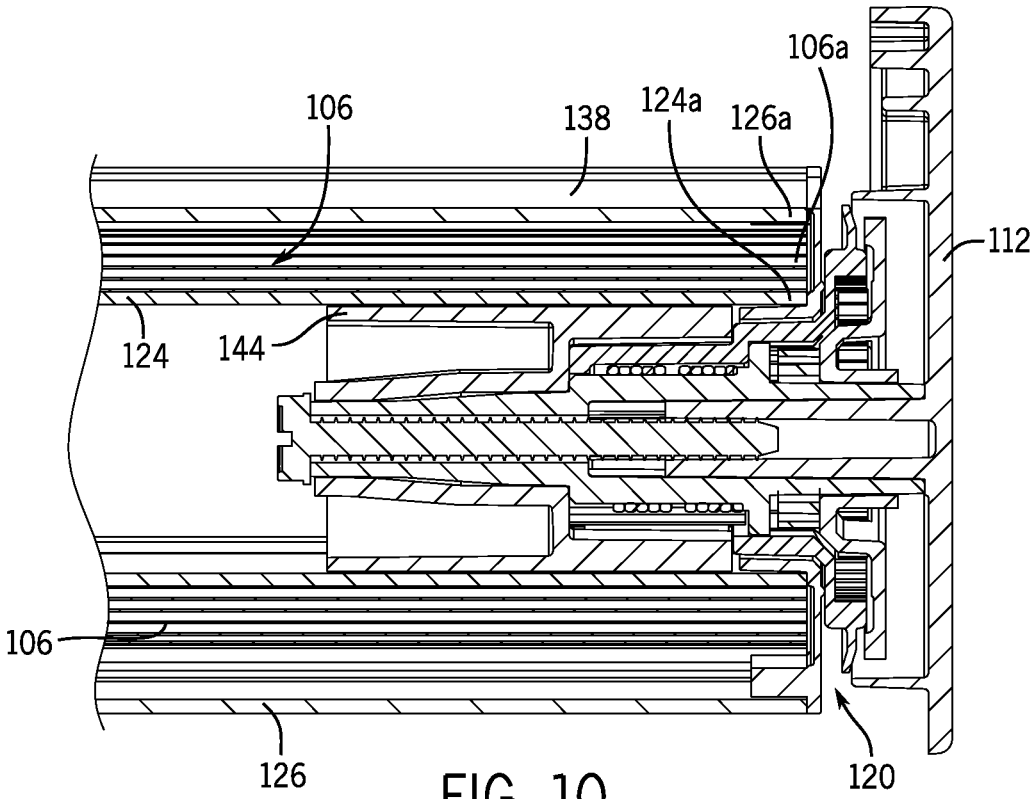
FIG. 10 is a lengthwise cross-sectional view of one end of the covering of FIG. 2 in accordance with some examples of the present disclosure.
Figure 11:
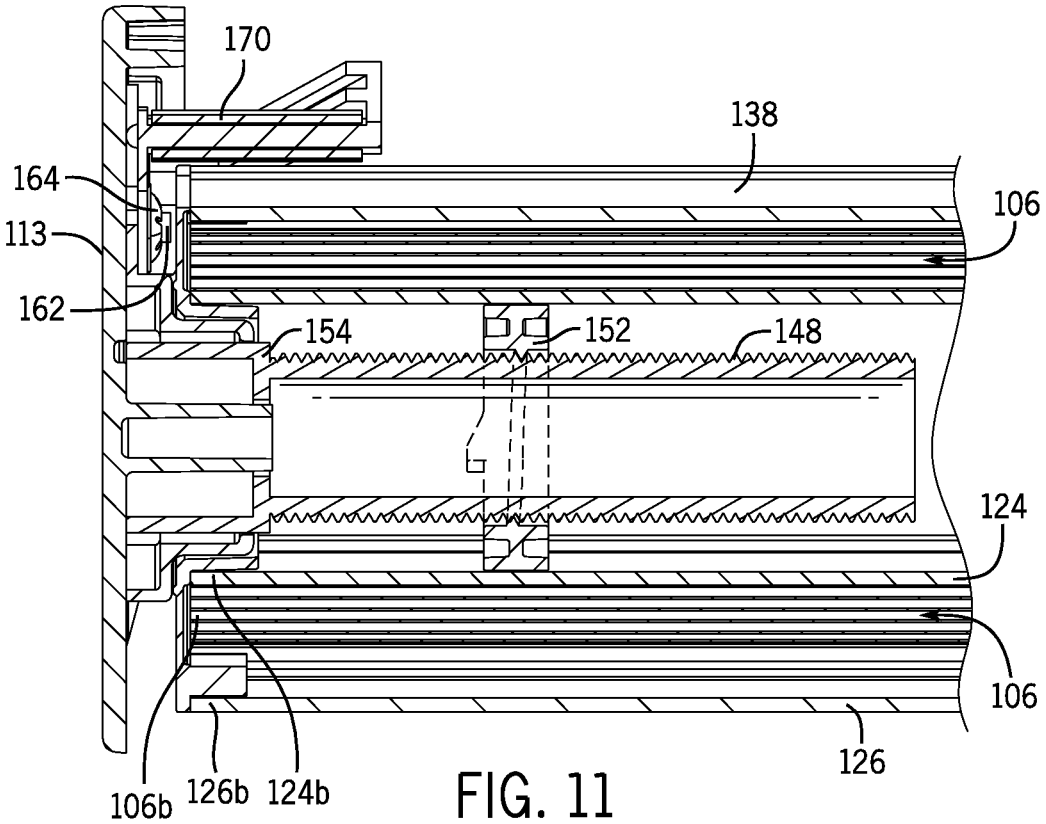
FIG. 11 is a lengthwise cross-sectional view of the other end of the covering of FIG. 2 in accordance with some examples of the present disclosure.

Referring still to FIGS. 4A and 4B, and FIGS. 10 and 11, the dual roller unit (for example, the inner and outer rollers 124, 126) is rotatably supported between the right end cap 112 and the left end cap 113, and the operating mechanism 120 is operably associated with the inner roller 124 to cause it to rotate. The operating mechanism 120 is anchored to the right end cap 112 and is actuated by, in one example, the operating element 122 as noted above. The operating mechanism 120 may, in one example, be a planetary gear drive often utilized in window covering applications. The operating mechanism 120 includes an internal fitting 144 which is rotated by the operating mechanism 120. The internal fitting 144 is sized to be received within the inner roller 124, and tightly engages the inner wall of the inner roller 124. The inner roller 124 is driven in rotation by the internal fitting 144 as the internal fitting 144 is driven by the operating mechanism 120. The open right end of the outer roller 126 receives a right end roller cap 146, which includes a central aperture having an axially extending collar rotatably receiving an axial bearing surface formed on the housing of the operating mechanism 120. The bearing surface supports the right end roller cap 146 as it rotates when the outer roller 126 rotates. The inner roller 124 is rotatably received on the collar. The collar rotatably supports the right end of the inner roller 124 as it is driven by the operating mechanism 120 to rotate. As shown in FIG. 10, right ends 124*a*, 126*a* of the inner and outer rollers 124, 126, respectively, may be aligned with one another, and a right side edge 106*a* of the second shade 106 may be aligned with the right ends 124*a*, 126*a* of the rollers 124, 126. As shown in FIG. 11, left ends 124*b*, 126*b* of the inner and outer rollers 124, 126, respectively, may be aligned with one another, and a left side edge 106*b* of the second shade 106 may be aligned with the left ends 124*b*, 126*b* of the rollers 124, 126.

The outer roller 126 is driven in rotation by the inner roller 124 when the second shade 106 is fully retracted onto the inner roller 124 and the second bottom rail 110 is received in the seat 142 of the outer roller 126. In this condition, as the inner roller 124 rotates, the second shade 106 tensions the second bottom rail 110, which in turn applies a force to the outer roller 126 at the interface between the second bottom rail 110 and the seat 142. Thus the outer roller 126 is caused to rotate in conjunction with the inner roller 124 in that arrangement. The outer roller 126 does not rotate along with the inner roller 124 unless the second shade 106 is fully retracted about the inner roller 124. As noted above, the operating mechanism 120 is included in the operating assembly, and is actuated by an operating element 122 to extend or retract the first and second shades 104, 106 as desired by the user. Many types of mechanisms for causing the rotation of the inner roller 124 upon actuation of the operating element 122 are acceptable.

Figure 8:
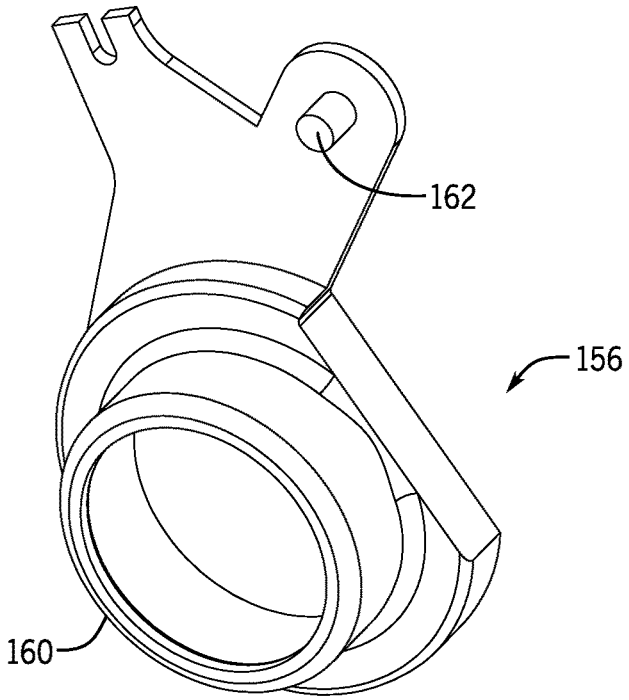
FIG. 8 is an isometric view of a bracket of the components of FIGS. 4A and 4B in accordance with some examples of the present disclosure.

Continuing with FIGS. 4A and 4B, a limit screw 148 is positioned inside the inner roller 124, and is operably fixed to the left end cap 113 by a screw. The limit screw 148 does not rotate. A limit nut 152 is threadedly engaged with the limit screw 148, and is rotationally keyed to the inside of the inner roller 124, the key structure allowing movement of the limit nut 152 along the length of the inner roller 124. As the inner roller 124 rotates, the limit nut 152 moves along the threaded limit shaft, and engages a bottom limit stop 154 defining the bottom most extended position of the second shade 106 (see FIG. 1). The retracted position of the first shade 104 is defined by the first shade 104, in this example, being wrapped entirely around the outer roller 126. In some examples, the first bottom rail 108 engages a portion of the head rail 102 to define this position. Alternatively or additionally, while a top limit stop on the limit screw 148 is not used in this example, one may be employed on the limit screw 148 if desired. The left end cap 113, as best seen in FIGS. 4A and B, and FIG. 11, rotatably supports the inner roller 124 and the outer roller 126. A pivot bracket 156 (see FIG. 8) is attached to the inside surface of a left end roller cap 158 and defines a centrally positioned annular boss 160 and a post 162 extending toward the right end cap 112 that serves as an axle on which the roller lock 134 is pivotally mounted. The annular boss 160 on the pivot bracket 156 is rotatably received in the central aperture of the left end roller cap 158, which is itself received in the open left end of the outer roller 126. A collar extends axially from around the central aperture of the left end roller cap 158, and serves as a bearing surface for the relative rotation between the outer roller 126 and the left end roller cap 158. The open left end of the inner roller 124 is rotatably received upon the outer surface of the collar, which acts as a bearing surface for the rotation of the inner roller 124 relative to the collar, which rotation is under the selective control through the operating mechanism 120.

Figure 12:
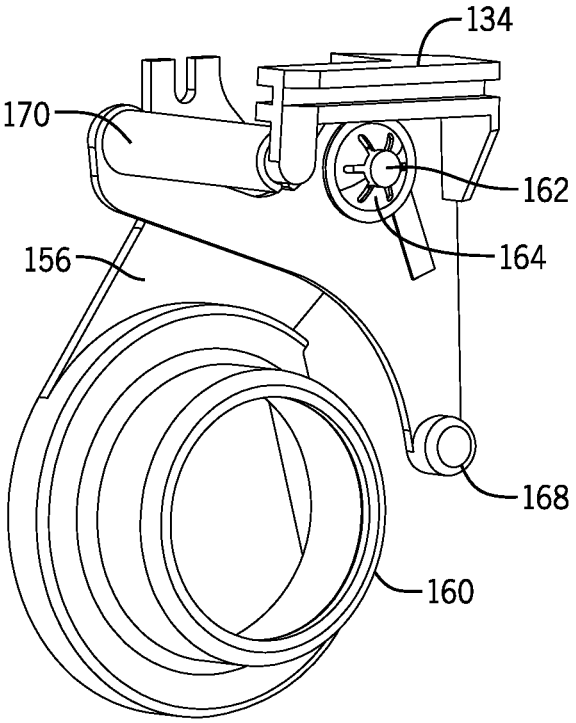
FIG. 12 is an isometric view of the lock mechanism of FIG. 7A rotatably mounted onto the bracket of FIG. 8 in accordance with some examples of the present disclosure.

The roller lock 134, as shown in FIGS. 4A and 4B, as well as FIGS. 7A-7F, is pivotally attached to the post 162 on the pivot bracket 156 (see FIG. 8), and secured thereto by a fastener 164 (see FIG. 12). The roller lock 134 can pivot relative to the pivot bracket 156 about the axis defined by the post 162. A spring member 166 (see FIG. 13) is positioned around the post 162 of the pivot bracket 156, the spring 166 having two legs, one of which engages the roller lock 134 to bias the roller lock 134 into engagement with the outer surface of the outer roller 126, and the other leg operably engages a portion of the left end cap 113. Referring to FIGS. 7A-7F, the roller lock 134 includes a frame plate 165 having a central body 167 from which extend an upper leg 169 and a lower leg 171, each leg lying in the same plane as the central body 167. The upper and lower legs 169, 171 extend at near right angles to one another, and it is contemplated that this relative positioning may be adjusted as needed given the geometry of the particular usage. The end of the lower leg 171 includes a pin 168 extending orthogonally from the plate 165 toward the right end cap 112, the pin 168 having a cylindrical shape and being relatively short. For instance, the pin 168 does not extend far enough to interfere with the rotation of the rollers 124, 126. The length and shape of the pin 168 facilitate the moving engagement between the pin 168 and the actuator rim 132 on the second bottom rail 110 as described below.

Continuing to refer to FIGS. 7A-7F, the end of the upper leg 169 rotatably supports a relatively long cylindrical bearing 170 which extends orthogonally from the upper leg 169 towards the right end cap 112. The roller lock bearing 170 is rotatably supported at its opposite end by an arm 173 extending at an angle from the frame plate 165. The arm 173 supports the distal end of the roller lock bearing 170 from a top side only, and does not extend much beyond the center of the roller lock bearing 170. This configuration leaves the lower portion of the roller lock bearing 170, along its length, unencumbered and able to be received in the anchor groove 138 formed in the outer roller 126, as well as to engage the outer surface of the outer roller 126 and ride along its surface, as described further below.

Figure 5A:
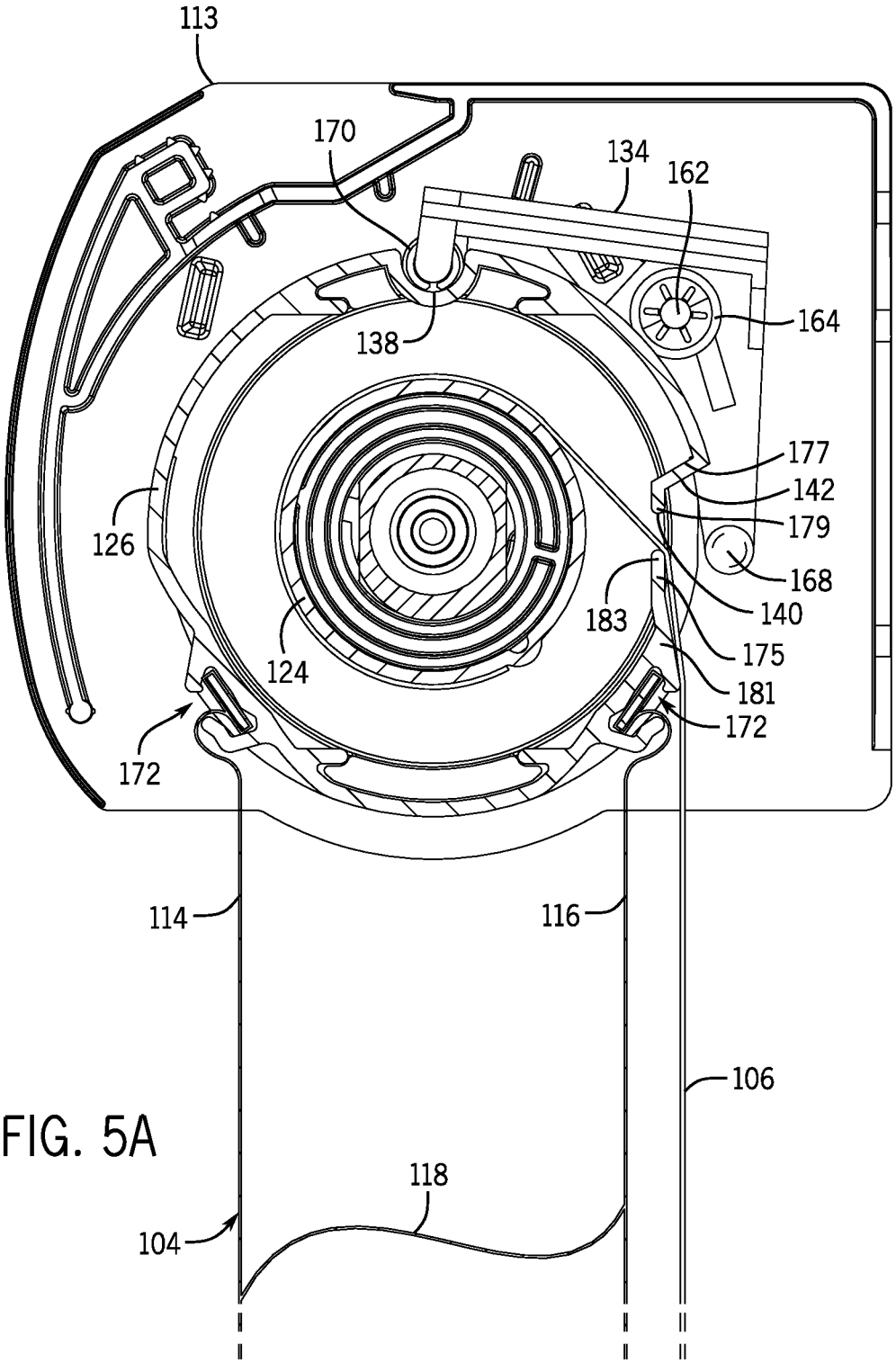
FIG. 5A is a transverse cross-sectional view of the covering of FIG. 1 taken along line 5A-5A of FIG. 1 in accordance with some examples of the present disclosure.

The operation of one example of the covering 100 is described below with primary reference to FIGS. 5A-E. As shown in FIG. 5A (taken from FIG. 1), both the first and second shades 104, 106 are in the extended position, and the vanes 118 are in an open configuration. With brief reference to FIG. 5A, the first shade 104 may be coupled to and wrappable about the outer roller 126. An upper edge of each of the front and rear sheets 114, 116 may be coupled to longitudinally extending glands or ribs, which may define the channels 172. The channels 172 may define an internal cavity that opens through a periphery of the outer roller 126. The first shade 104 may be wrapped about or unwrapped from a rear side of the outer roller 126, with the rear side of the outer roller 126 positioned between a front side of the outer roller 126 and a street side of an associated architectural opening (in FIG. 5A, the rear side of the outer roller 126 is to the right). Generally, rotation of the outer roller 126 in a first direction (counterclockwise in FIG. 5A) retracts the first shade 104 by winding it about the outer roller 126 to a position adjacent one or more sides (such as the top side) of an associated architectural opening and rotation of the outer roller 126 in a second, opposite direction may extend the first shade 104 across the opening (such as to the bottom side).

The first shade 104 is maintained in this open position by positioning the engagement points of the rear and front sheets 116, 114 of the first shade 104 with the outer roller 126 at the same height. In FIG. 5A, for instance, the positions of these attachment points may be referred to as being at 4 o'clock and 8 o'clock, which puts them at the very close to the same level with each other. If the outer roller 126 is rotated either direction from that shown in FIG. 5A, the front and rear sheets 114, 116 would move toward one another and the vanes 118 would re-orient into more vertical alignment.

At this position with both the first and second shades 104, 106 at the fully extended position, the limit nut 152 (see generally FIGS. 4A and 4B) is engaged with the bottom stop limit 154. Actuation of the operating mechanism 120, such as by the operating element 122, from this position begins the retraction of the shades 104, 106 into the head rail 102. The operating mechanism 120 first rotates the inner roller 124 in a counter-clockwise direction in FIG. 5A to retract the second shade 106, and when that is fully retracted, the outer roller 126 is then actuated to retract the first shade 104 onto the outer roller 126. This sequence is described further herein and below.

As noted above, and referring still to FIG. 5A, the inner roller 124 is positioned within the outer roller 126 to define the dual roller unit. The outer roller 126 defines an axis of rotation 143 (see FIGS. 4A and 4B) defined by the portion of the outer roller 126 having a circular shape (such as from 9 o'clock to 2 o'clock). The inner roller 124 is positioned so as to be coextensive with the same axis as the outer roller 126.

During retraction of the second shade 106, the inner roller 124 rotates relative to the outer roller 126, with the opposing collars in the left and right roller caps 158, 146 supporting the respective ends of the inner roller 124. The outer roller 126 is held in fixed rotational position relative to the inner roller 124 by the roller lock 134. The roller lock 134 is oriented such that the roller lock bearing 170 is biased by the spring 166 to be received in the anchor groove 138 (see FIGS. 5A, 4A, and 4B). This position of the roller lock bearing 170 inhibits the rotation of the outer roller 126. As the inner roller 124 rotates in the retraction direction, the second shade 106 is wound onto the inner roller 124 as it is pulled through the slot 140 formed in the outer roller 126. This retraction rotation moves the limit nut 152 along the limit screw 148 towards the opposite end of the limit screw 148.

The slot 140 through which the second shade 106 extends, and the seat 142 for receiving the second bottom rail 110 is positioned on the circumference of the outer roller 126 above the attachment point of the rear sheet 116 of the first shade 104. This may be referred to in FIG. 5A as 3 o'clock. The slot 140 is defined by opposing free edges formed in the seat 142. The seat 142 is a recess formed along the length of the slot 140, and includes two outer edges that define the boundaries of the seat 142 on the circumference of the outer roller 126. The shape of the recess, as oriented in FIG. 5A, is somewhat angular overall, with a generally vertically oriented base wall 175 allowing a relatively vertical-tangential engagement and disengagement between the second bottom rail 110 and the outer roller 126. The location of the seat 142 and slot 140 near the furthest rearward position on the circumference of the outer roller 126, along with the shape of the seat 142, allows for secure receipt of the second bottom rail 110 as it is pulled vertically up and into the seat 142 during retraction (see FIGS. 5B and 5C).

Figure 5B:
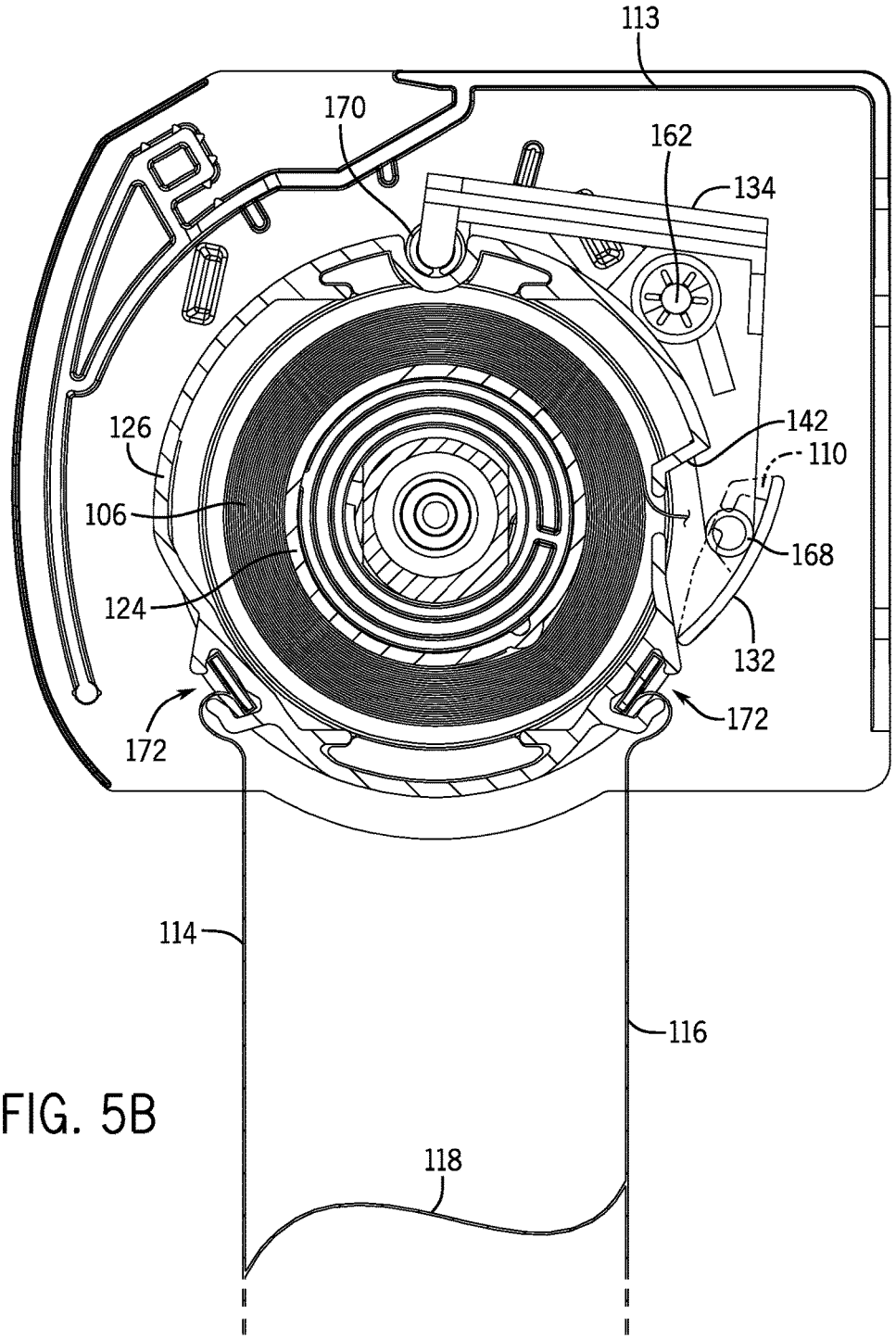
FIG. 5B is a transverse cross-sectional view of the covering of FIG. 1 taken along line 5B-5B of FIG. 2 in accordance with some examples of the present disclosure.
Figure 5C:
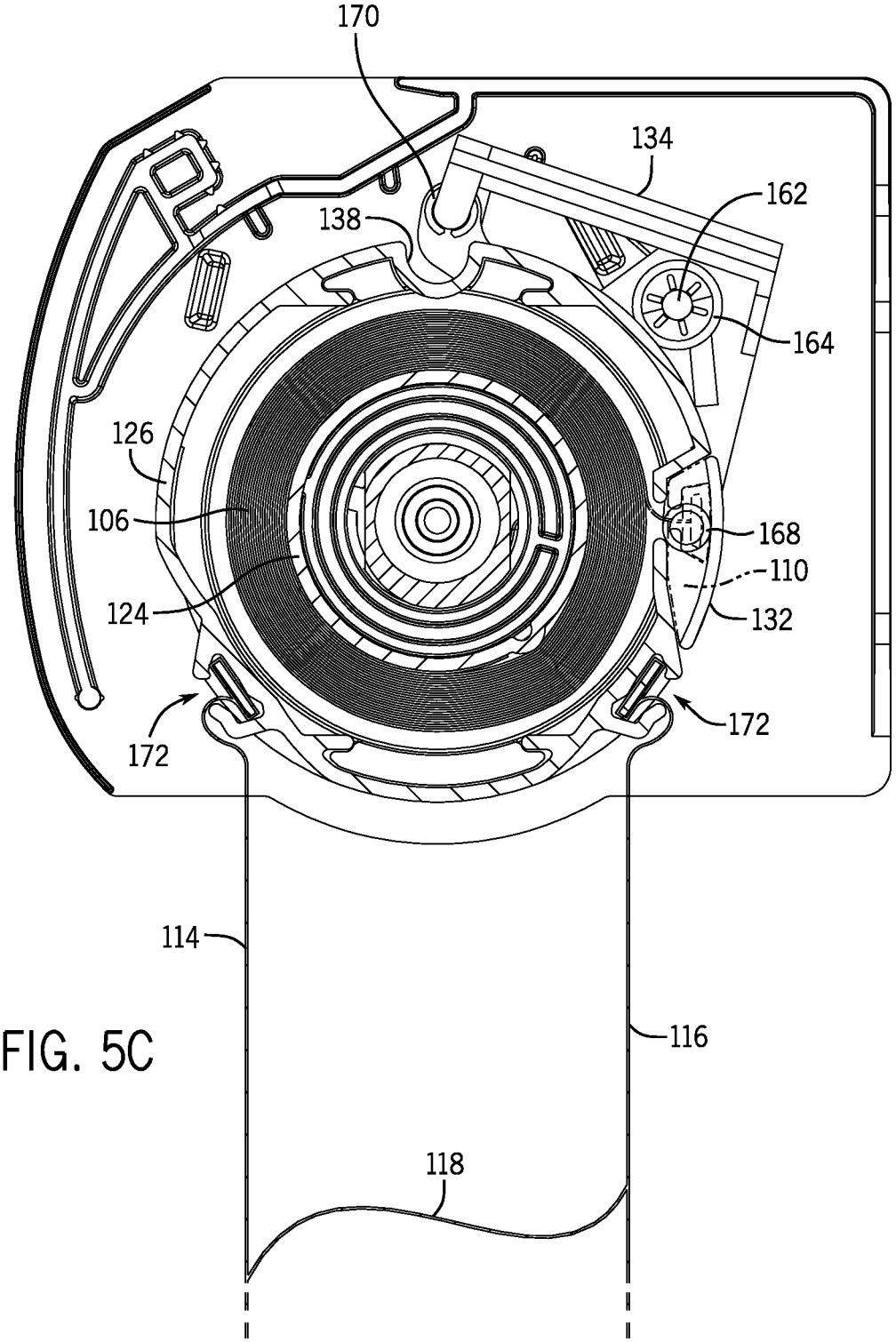
FIG. 5C is a transverse cross-sectional view of the covering of FIG. 1 taken along line 5B-5B of FIG. 2 with a bottom rail seated against the outer roller and a lock mechanism unseated from the outer roller in accordance with some examples of the present disclosure.

The shape of the seat 142 and its orientation on the outer roller 126 encourages smooth and predictable disengagement of the second bottom rail 110 from the seat 142 to begin the extension of the second shade 106 (from the position shown in FIG. 5C). The shape and orientation of the seat 142 allows the second bottom rail 110 to drop vertically out of the seat 142, which takes advantage of the force of gravity on the relatively heavy second bottom rail 110. The generally tangential orientation of the seat 142 on the outer roller 126 assists in this regard. The upper wall 177 of the seat 142 extends from the top edge of the recess downwardly and radially inwardly to a lip, which extends directly downwardly to an upper free edge 179. This portion of the seat 142 is the deepest (as measured from the circumference toward the center of the outer roller). The lower wall 181 of the seat 142 extends from the bottom edge of the recess upwardly and inwardly at a shallow angle, and transitions to a lip which defines the lower free edge 183 of the slot 140. The lower wall 181 is relatively vertical, and remains so even in combination with the upper lip. The lower free edge 183 of the slot 140 may be curved or rounded to allow for the smooth travel of the second shade 106 over this feature as it is retracted onto the inner roller 124.

Figure 6A:
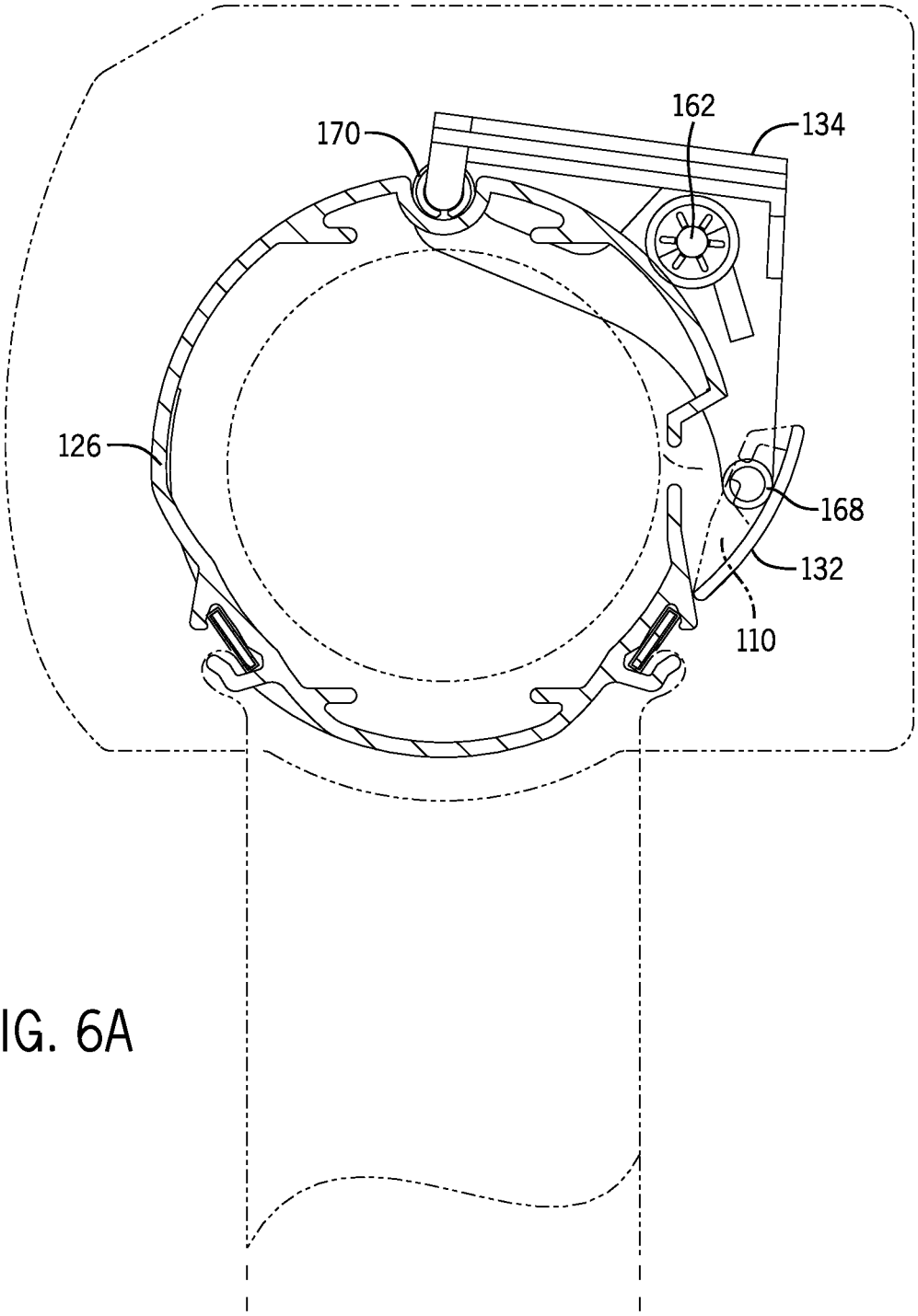
FIG. 6A is another view of the covering of FIG. 5B with the inner roller and second shade removed for clarity in accordance with some examples of the present disclosure.

The secure engagement of the second bottom rail 110 in the seat 142 aids in consistent actuation of the roller lock 134 to disengage the roller lock bearing 170 from the anchor groove 138. Referring to FIG. 5B, when the second shade 106 is near fully wound around the inner roller 124, the second bottom rail 110 of the second shade 106 engages the roller lock 134 to disengage the roller lock 134 from the outside of the outer roller 126. The second bottom rail 110 is shown in dash in FIGS. 5B and 6A. At this position, the actuator rim 132, which extends axially from the end of the second bottom rail 110, contacts the pin 168 formed on the lower leg 171 of the roller lock 134. As the second bottom rail 110 is pulled into the seat 142 by the second shade 106 being retracted, the actuator rim 132 moves the pin 168 relative to the pivot axis defined by the post 162. The pin 168 is moved radially inwardly relative to the inner roller 124, and is moved circumferentially relative to the pivot axis of the roller lock 134. The movement of the roller lock 134 about the pivot axis moves the upper leg 169, which begins the movement of the roller lock bearing 170 upwardly and out of engagement with the anchor groove 138, which frees the outer roller 126 to rotate (see FIGS. 5C, 6B, and 13).

Figure 9:
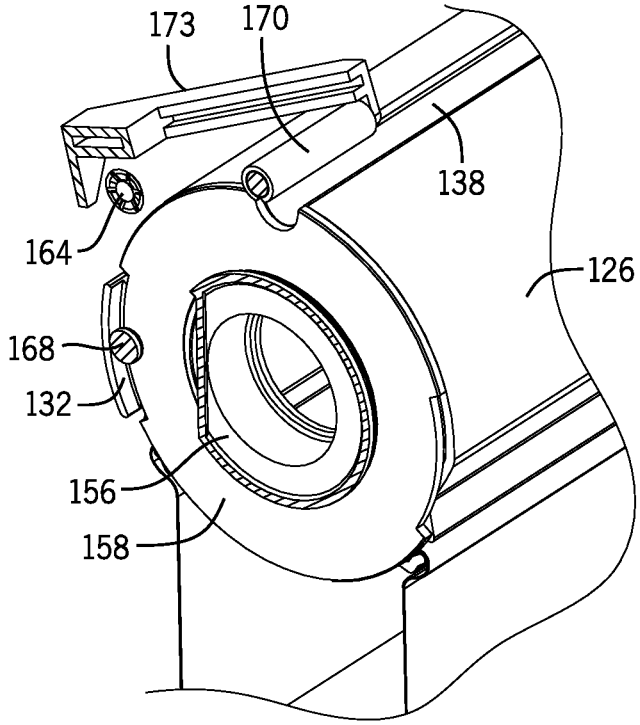
FIG. 9 is a transverse cross-sectional view of the lock mechanism of FIG. 7A in an unlocked position relative to an outer roller of the covering of FIG. 2 in accordance with some examples of the present disclosure.
Figure 13:
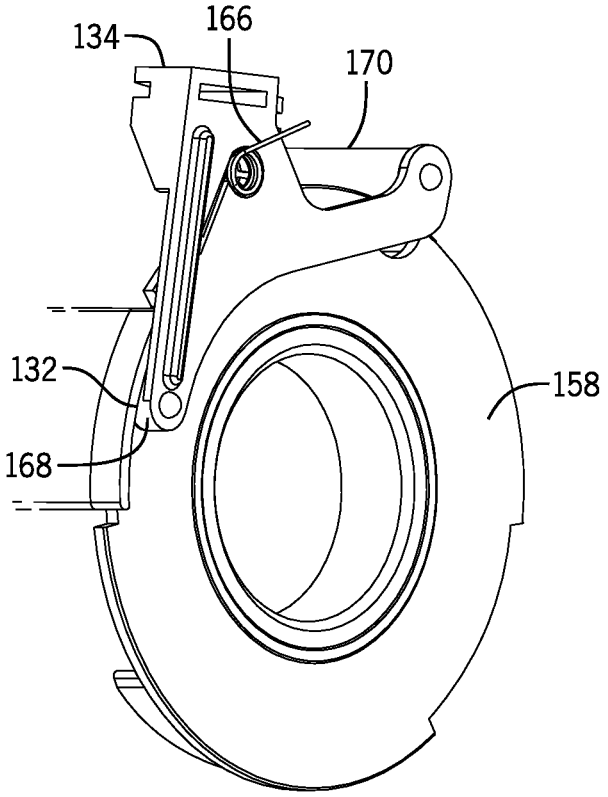
FIG. 13 is a fragmentary isometric view of some of the components of FIGS. 4A and 4B and depicts the lock mechanism of FIG. 7A interacting with the bottom rail of FIGS. 4A and 4B in accordance with some examples of the present disclosure.
Figure 14:
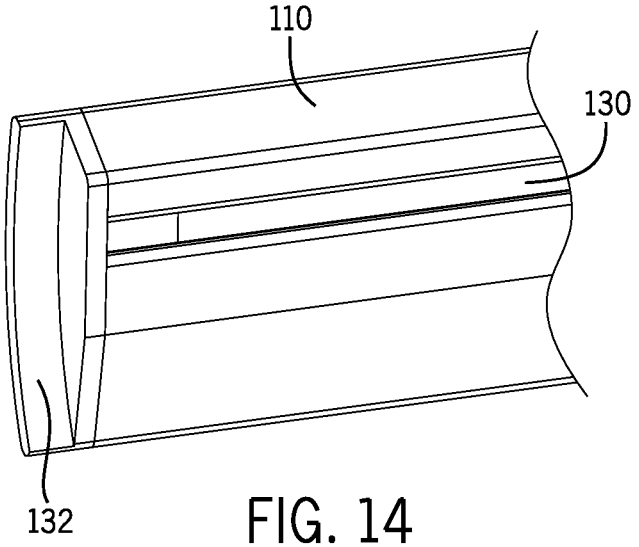
FIG. 14 is a fragmentary view of an end portion of the bottom rail of FIGS. 4A and 4B in accordance with some examples of the present disclosure.
Figure 15:
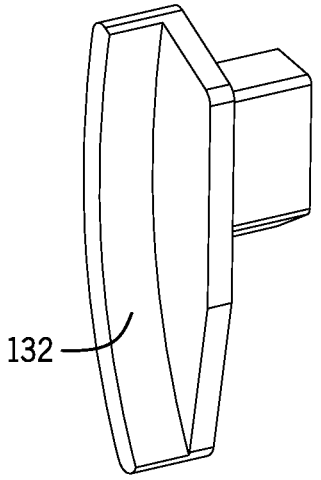
FIG. 15 is an isometric view of an actuator rim of the bottom rail of FIG. 14 in accordance with some examples of the present disclosure.

As shown in FIGS. 9 and 13, the actuator rim 132 extends off of the end of the second bottom rail 110 adjacent the roller lock 134. With reference to FIGS. 14 and 15, the actuator rim 132 is a thin, curved element that in this example conforms to the curved shape of the bottom side of the second bottom rail 110. The actuator rim 132 is curved along a dimension consistent with the bottom side of the second bottom rail 110, and extends axially away from the second bottom rail 110. As best seen in FIG. 13, the actuator rim 132 extends a distance sufficient to engage the pin 168 on the roller lock 134 but not contact the central plate of the roller lock 134. The inside, concave surface of the actuator rim 132 engages the round outer surface of the pin 168. As the second bottom rail 110 is further retracted, the pin 168 and actuator rim 132 maintain a sliding engagement. This further movement of the second bottom rail 110 causes the roller lock 134 to pivot further about the pivot axis defined by the post 162 and thus moves the roller lock bearing 170 out of the anchor groove 138.

Figure 6B:
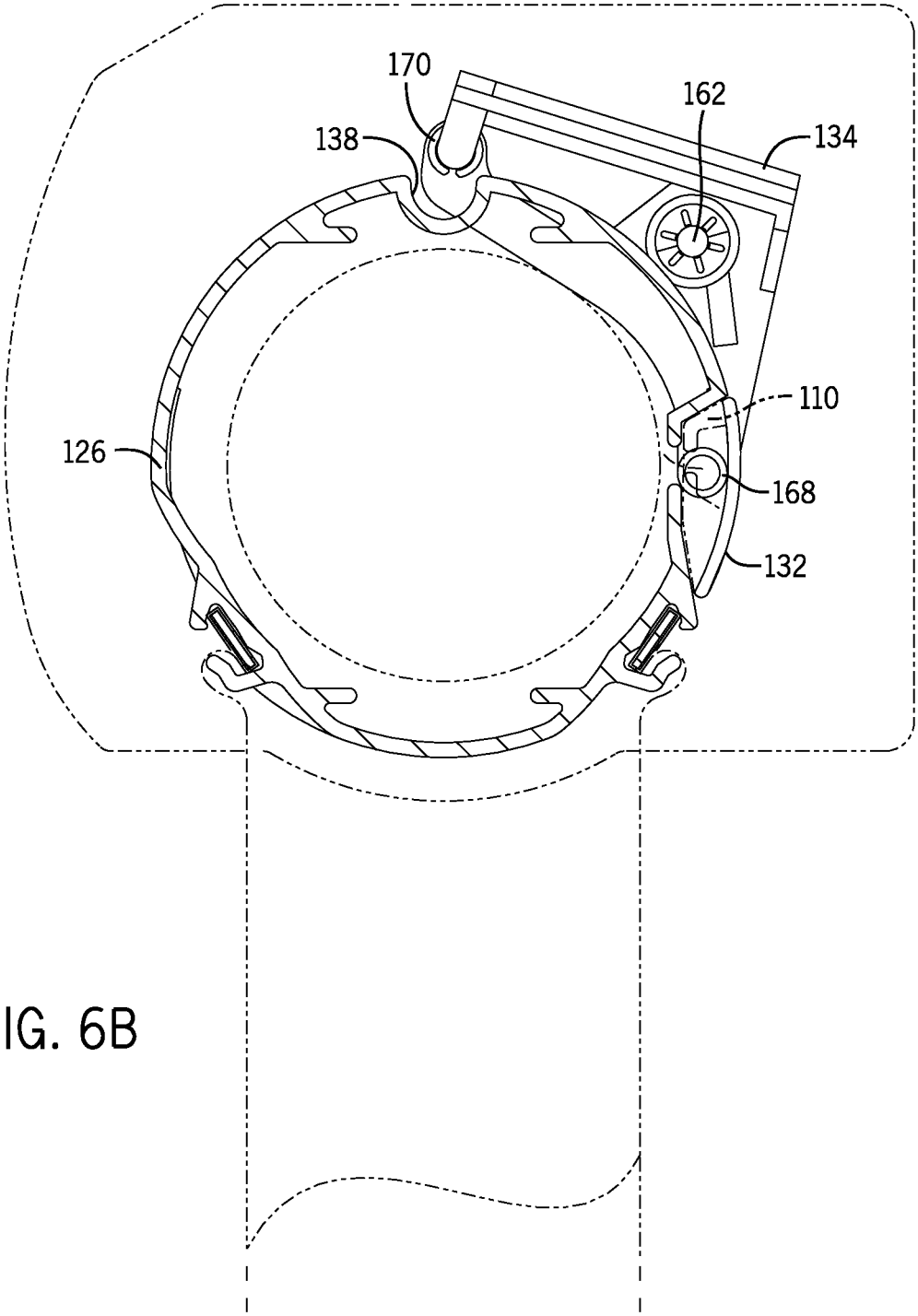
FIG. 6B is another view of the covering of FIG. 5C with the inner roller and second shade removed for clarity in accordance with some examples of the present disclosure.

Referring to FIGS. 5C and 6B, as the second shade 106 is further withdrawn into the outer roller 126, the second bottom rail 110 becomes securely positioned in the seat 142 and the actuator rim 132 moves the pin 168 a sufficient amount inwardly to fully remove the roller lock bearing 170 from the anchor groove 138, which frees the outer roller 126 to rotate. Further actuation of the operating mechanism 120 applies the rotational motion of the inner roller 124 to the outer roller 126, through the engagement of the second bottom rail 110 in the seat 142 under the tension of the second shade 106. This engagement causes the outer roller 126 to rotate in conjunction with the rotation of the inner roller 124.

Figure 5D:
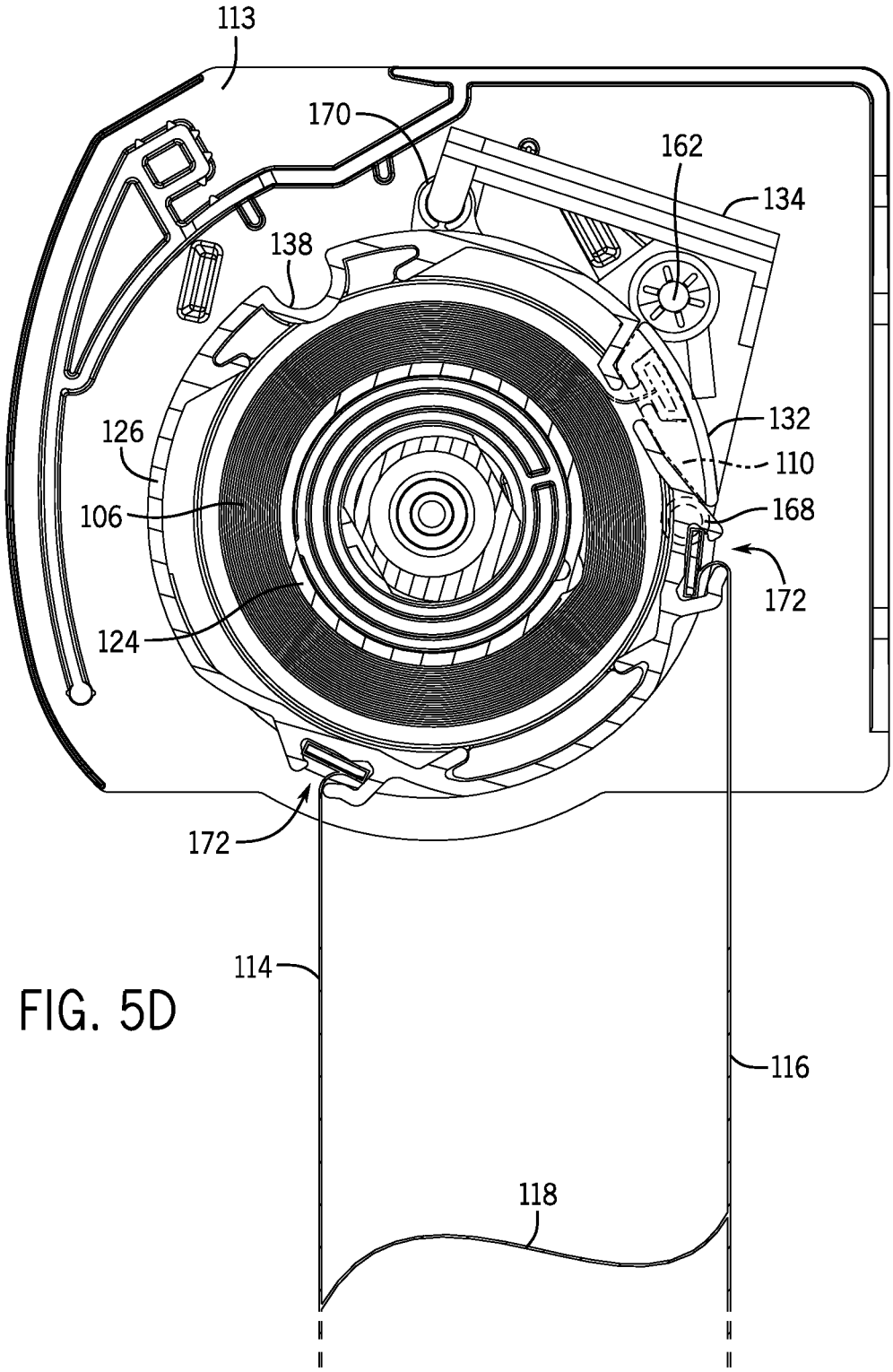
FIG. 5D is a transverse cross-sectional view of the covering of FIG. 1 taken along line 5B-5B of FIG. 2 with the outer roller rotated counterclockwise relative to the position of the outer roller in FIG. 5C in accordance with some examples of the present disclosure.
Figure 6C:
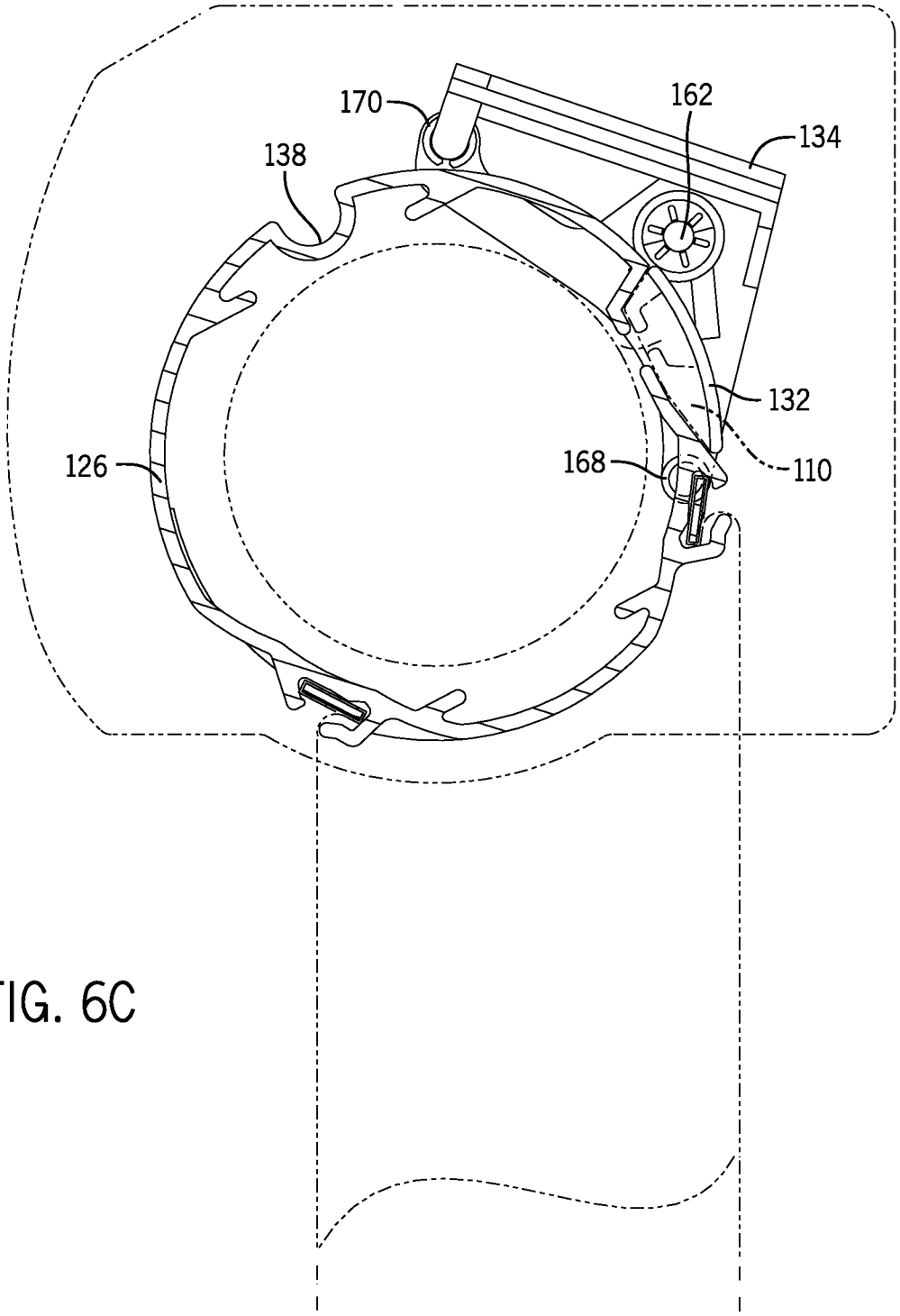
FIG. 6C is another view of the covering of FIG. 5D with the inner roller and second shade removed for clarity in accordance with some examples of the present disclosure.
Figure 7A:
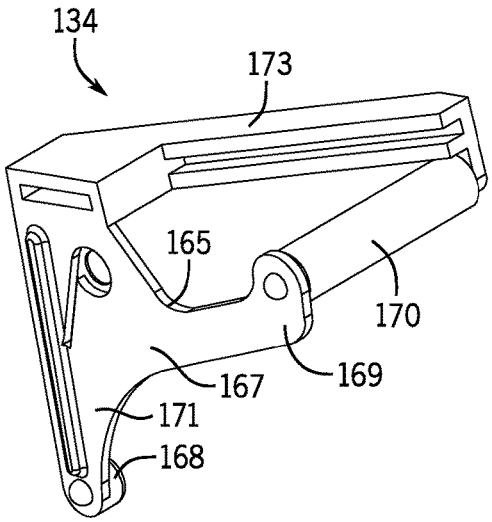
FIG. 7A is an isometric view of a lock mechanism of the components of FIGS. 4A and 4B in accordance with some examples of the present disclosure.
Figure 7B:
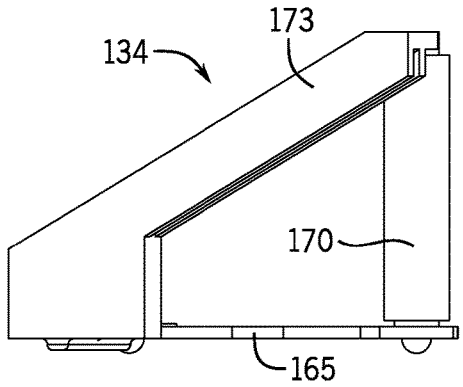
FIG. 7B is top plan view of the lock mechanism of FIG. 7A in accordance with some examples of the present disclosure.
Figure 7C:
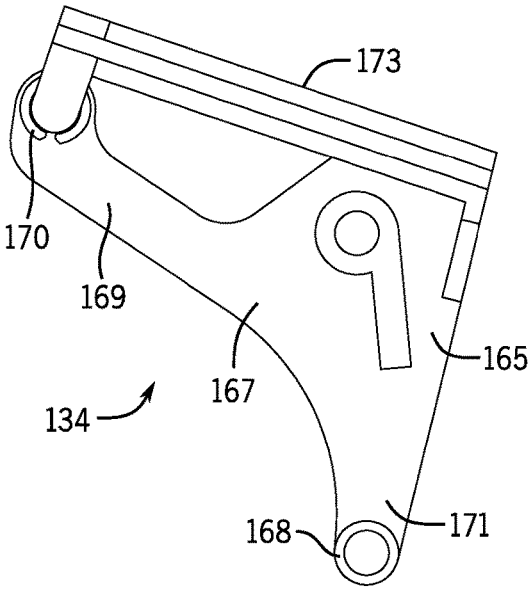
FIG. 7C is a side elevation view of the lock mechanism of FIG. 7A in accordance with some examples of the present disclosure.
Figure 7D:
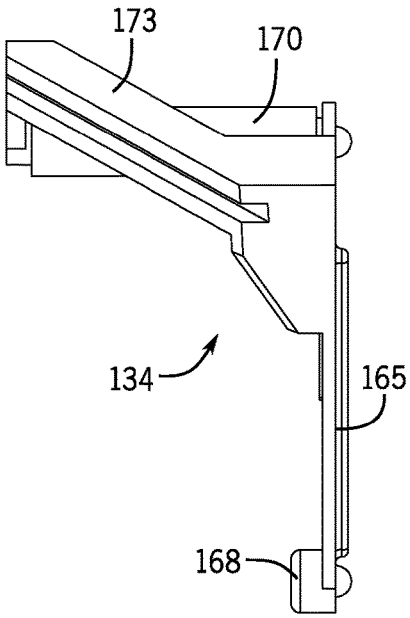
FIG. 7D is a rear elevation view of the lock mechanism of FIG. 7A in accordance with some examples of the present disclosure.
Figure 7E:
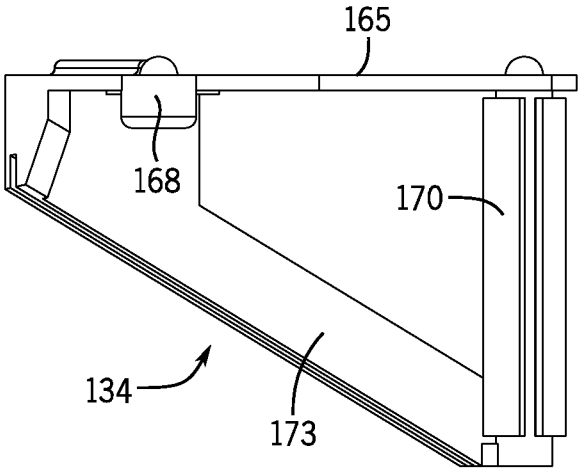
FIG. 7E is a bottom plan view of the lock mechanism of FIG. 7A in accordance with some examples of the present disclosure.
Figure 7F:
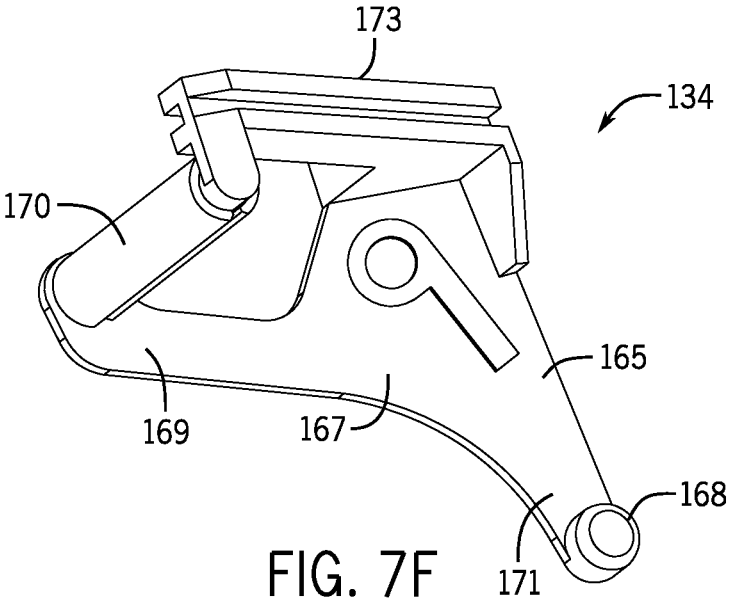
FIG. 7F is another isometric view of the lock mechanism of FIG. 7A in accordance with some examples of the present disclosure.
Figure 7G:
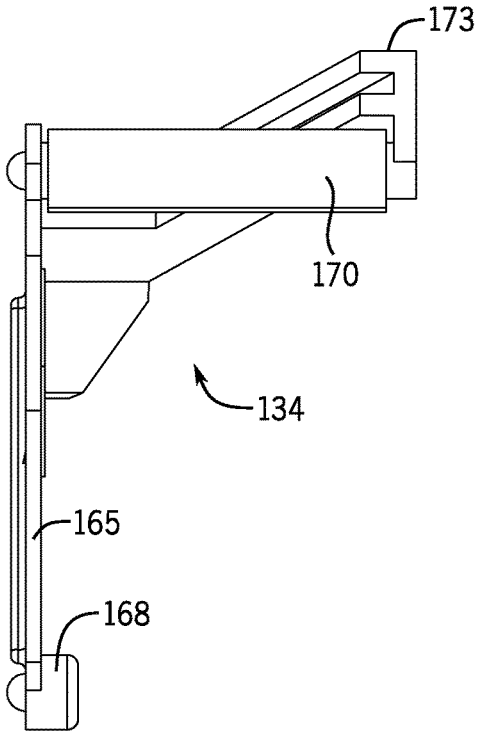
FIG. 7G is a front elevation view of the lock mechanism of FIG. 7A in accordance with some examples of the present disclosure.

As the outer roller 126 begins to rotate in the retraction direction, the actuator rim 132 on the second bottom rail 110 disengages from the pin 168 on the roller lock 134. Referring to FIGS. 5D and 6C, upon release the roller lock 134 is biased by the spring 166 to cause the roller lock bearing 170 to contact the outer surface of the outer roller 126 at a circumferential location spaced away from the anchor groove 138.

Figure 5E:
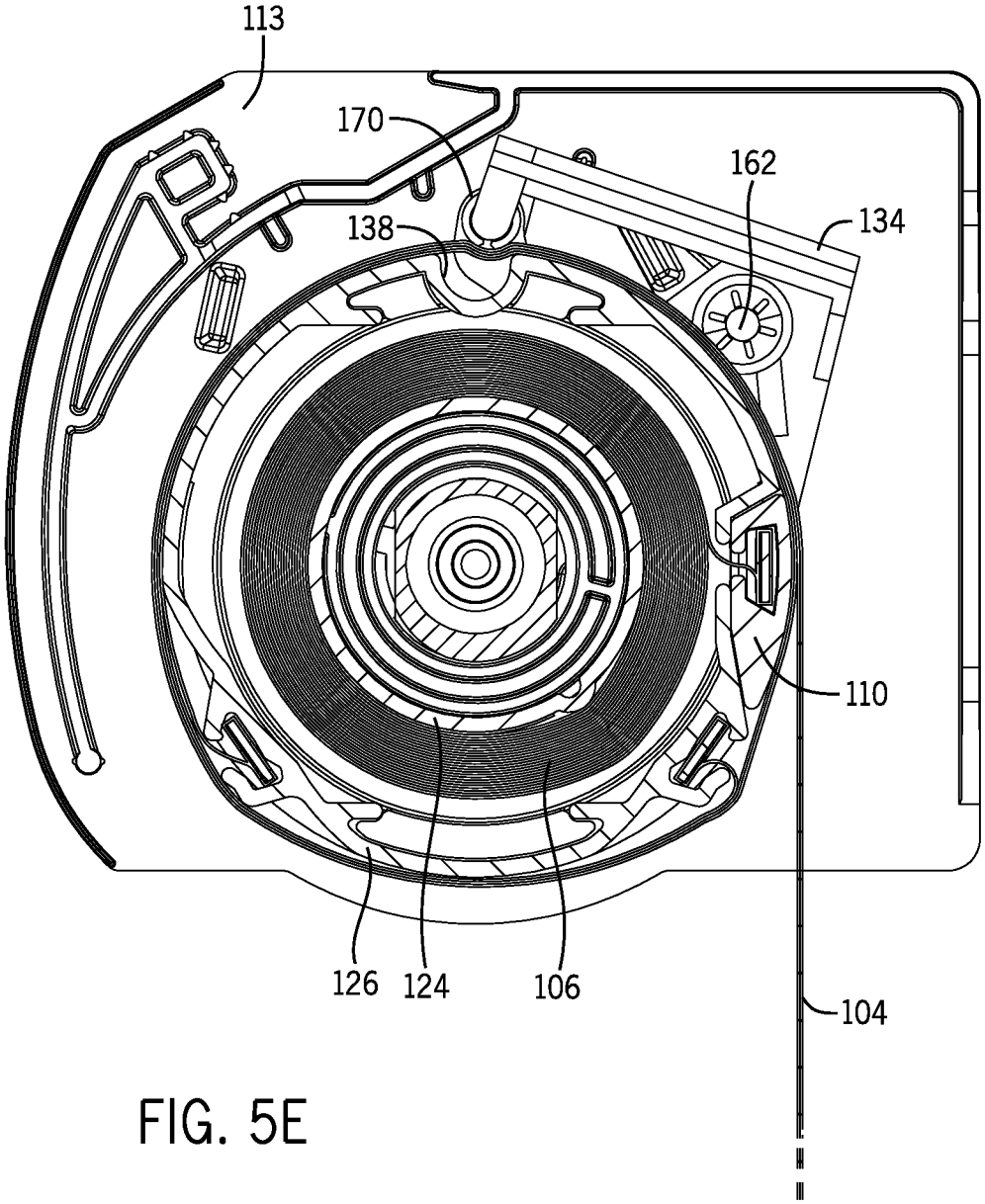
FIG. 5E is a transverse cross-sectional view of the covering of FIG. 1 taken along line 5E-5E of FIG. 3 in accordance with some examples of the present disclosure.

Referring to FIG. 5E, as the outer roller 126 continues to rotate in the retraction direction, the first shade 104 wraps around the outer roller 126, covering the anchor groove 138. When the roller lock bearing 170 nears the anchor groove 138 as the outer roller 126 continues to rotate, the roller lock bearing 170 passes over the anchor groove 138 by riding on the first shade 104 spanning the anchor groove 138. The first shade 104 is under tension as it is wrapped around the outer roller 126, thus making the span of the first shade 104 extending over the anchor groove 138 relatively taut. The roller lock bearing 170 may depress somewhat into the anchor groove 138 when only a single pass of the first shade 104 is positioned over the anchor groove 138, but after another full rotation the roller lock bearing 170 rides over the surface of the first shade 104 wrapped around the outer roller 126 without interference from the anchor groove 138.

As the first shade 104 continues to retract, it wraps around the outer roller 126 many times, and the roller lock bearing 170 continues to ride on the outer surface of the first shade 104. The dual roller unit (for example, the inner and outer rollers 124, 126) reaches the top retraction position when the first bottom rail 108 contacts an abutment on the head rail 102. It is contemplated that other mechanisms may be utilized to define the top retraction position, including a top limit stop positioned on the limit screw 148 opposite the bottom limit stop 154.

As explained above, the retraction of the second shade 106 and first shade 104 from the fully extended position occurs with the user actuating one operating element 122 (manually or automatically) for the retraction of both shades 104, 106. The limit screw 148 is of sufficient length to allow the limit nut 152 to move from the bottom limit stop 154 until the top retracted position is attained.

Extension of the first shade 104 and the second shade 106, if desired, is accomplished in reverse order as described above, such as generally following FIGS. 5E to 5A. This allows the user to select whether to have just the first shade 104 extended or to also have the second shade 106 extended (between fully retracted and fully extended). During extension of the first shade 104, the user actuates the operating mechanism 120 to cause the inner roller 124 to rotate in an extension direction (clockwise in FIGS. 5E-5A), which in turn causes the outer roller 126 to rotate in an extension direction. The dual roller unit rotates, in this example, in the direction the user controls the inner roller 100 to rotate. As the first shade 104 extends off of the rear of the outer roller 126, the roller lock bearing 170 rides on the outer surface of the outer roller 126 until the first shade 104 is nearly fully extended. At this point, the outer surface of the outer roller 126 is exposed. As the outer roller 126 continues to rotate, the roller lock bearing 170 rides on the outer surface of the outer roller 126 until it meets the anchor groove 138. The roller lock bearing 170 is biased downwardly by the spring 166 to be positioned in the anchor groove 138 and inhibit the rotation of the outer roller 126 and allow the continued rotation of the inner roller 124 (if desired by the user). Since the roller lock 134 is biased in a direction against the outer surface of the outer roller 126, the roller lock bearing 170 moves into the anchor groove 138 without further urging. At this point the first shade 104 is at its most extended position in the architectural opening. It is contemplated that the roller lock 134 may be biased by means other than a spring 166 in these examples. For instance, the top arm 173 of the roller lock 134 may be weighted such that the roller lock 134 pivots as desired automatically under the weight. Where a spring 166 is used, it may be a wire spring, coil spring, resilient material spring (such as rubber, elastic, plastic) or the like.

When the roller lock bearing 170 is seated in the anchor groove 138, the slot 140 in the outer roller 126 is rotationally oriented within the head rail 102 such that the second bottom rail 100 of the second shade 106 may drop vertically out of the seat 142 when the tension in the second shade 106 is lessened by the operating system. The generally tangential orientation and generally vertical positioning of the seat 142, with a relatively vertical base wall 175, allows the weight of the second bottom rail 110 to be effective to extract the second bottom rail 110 from the seat 142 when the tension in the second shade 106 is released in the retraction position. However, if the user does not intend to extend the second shade 106, then the second shade 106 may remain retracted. The operating mechanism 120 may include a brake system to restrict unwanted downward movement of the second or first shades 106, 104.

In order to extend the second shade 106, the operating mechanism 120 is further actuated to the level as desired by the user. When the user extends the second shade 106 to the lowest position (most extension), the limit nut 152 is positioned on the limit screw 148 in engagement with the bottom limit stop 154. Thus a single limit screw 148 is utilized to define the upper limit of the retracted first shade 104 attached to the outer roller 126, and to define the lower limit of the extended second shade 106 attached to the inner roller 124.

It is contemplated that a first shade 104 of FIGS. 5A-5E (the same as or different than that shown in FIG. 5A) may be wrapped about or unwrapped from the front side of the outer roller 126. Accompanying modifications to the structure described herein necessary to facilitate the implementation of the dual roller shade technology as applied to a front-descending shade structure are contemplated. It is also contemplated that the roller lock mechanism 134 and accompanying elements necessary for it to operate may be employed on the right end of the head rail 102, in affiliation with the right end cap 112, either in conjunction with a roller lock mechanism 134 on the left end of the head rail 102, or by itself. Also, the second bottom rail 110 may have an actuator rim 132 on either end thereof.

The foregoing description has broad application. While the provided examples describe a silhouette-type shade, it should be appreciated that the concepts disclosed herein may equally apply to many types of shades. Accordingly, the discussion of any embodiment is meant only to be explanatory and is not intended to suggest that the scope of the disclosure, including the claims, is limited to these examples. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

The phrases "at least one", "one or more", and "and/or", as used herein, are open-ended expressions that are both conjunctive and disjunctive in operation.

The term "a" or "an" entity, as used herein, refers to one or more of that entity. As such, the terms "a" (or "an"), "one or more" and "at least one" can be used interchangeably herein.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

What is claimed is:

1. A covering for an architectural opening, comprising:

an outer roller having a central longitudinal axis and an elongated slot formed through a sidewall, the elongated slot extending between ends of the outer roller;

an inner roller having a central longitudinal axis and received within the outer roller;

a first shade coupled to and adapted to be wrapped around the outer roller;

a second shade defining a bottom rail and coupled to and adapted to be wrapped around the inner roller;

a mounting system supporting the inner and outer rollers for rotative movement;

the second shade extending through the elongated slot and being retractable onto and extendable from the inner roller therethrough, the bottom rail engaging the outer roller when the second shade is in a fully retracted position;

an operating mechanism for selectively rotating the inner roller; and a lock mechanism selectively movable between a first position restricting rotation of the outer roller and a second position permitting rotation of the outer roller, wherein in the first position the lock mechanism contacts the sidewall of the outer roller, and the lock mechanism moves from the first position to the second position upon engagement of the bottom rail with the lock mechanism.

2. The covering as defined in claim 1, wherein:

the outer roller defines a longitudinal seat formed along the slot; and the second bottom rail is received in the seat when the second shade is in the fully retracted position.

3. The covering as defined in claim 2, wherein the slot is oriented orthogonally to a direction of extension of the first shade.

4. The covering as defined in claim 3, wherein the seat defines a recess with an opening in a direction of extension of the first shade.

5. The covering as defined in claim 1, wherein:

the outer roller defines an elongated groove formed in the sidewall;

the lock mechanism includes a bearing; and in the first position of the lock mechanism, the bearing is received in the groove.

6. The covering as defined in claim 5, wherein:

the lock mechanism includes a pin; and the lock mechanism is actuated upon engagement of the pin by the bottom rail to remove the bearing from the groove.

7. The covering as defined in claim 6, wherein the bearing movably engages the outer surface of the outer roller in the second position.

8. The covering of claim 1, wherein rotation of the inner roller when the second shade is in the fully retracted position causes rotation of the outer roller.

9. A covering for an architectural opening, comprising:

an outer roller having an elongated slot formed through a sidewall, the elongated slot extending between ends of the outer roller;

an inner roller received within the outer roller;

a first shade coupled to and adapted to be wrapped around the outer roller;

a second shade coupled to and adapted to be wrapped around the inner roller, the second shade including a bottom rail; and a lock mechanism selectively movable between a first position wherein the lock mechanism directly locks the outer roller from further rotation, and a second position wherein the lock mechanism permits rotation of the outer roller, and wherein the lock mechanism moves from the first position to the second position upon contact of the bottom rail with the lock mechanism.

10. The covering as defined in claim 9, wherein the second shade extends through the elongated slot and is retractable onto and extendable from the inner roller through the elongated slot.

11. The covering as defined in claim 9, wherein the inner roller and the outer roller share a common central longitudinal axis.

12. The covering as defined in claim 9, wherein the lock mechanism is pivotable between the first position and the second position.

13. The covering as defined in claim 9, wherein in the first position the lock mechanism is seated in a groove formed in an outer surface of the outer roller.

14. A covering for an architectural opening, comprising:

an outer roller having an elongated slot formed through a sidewall, the elongated slot extending between ends of the outer roller;

an inner roller received within the outer roller;

a first shade coupled to and wrappable around the inner roller;

a second shade coupled to and adapted to be wrapped around the inner roller, the second shade including a bottom rail; and a lock mechanism selectively movable between a first position restricting rotation of the outer roller and a second position permitting rotation of the outer roller, wherein in the first position the lock mechanism contacts the sidewall of the outer roller;

wherein the lock mechanism moves from the first position to the second position upon contact of the bottom rail with the lock mechanism.

* * * * *